US008517625B2

(12) United States Patent
McCoy et al.

(10) Patent No.: US 8,517,625 B2
(45) Date of Patent: Aug. 27, 2013

(54) APPARATUS AND METHOD FOR DISABLING A GROUND ENGAGING TRACTION DEVICE OF A LAND VEHICLE

(75) Inventors: Robert Arthur McCoy, Phoenix, AZ (US); Brian D. Rosner, Phoenix, AZ (US); Patrick J. Barnhill, Phoenix, AZ (US); Gregg D. Spendlove, Ogden, UT (US); Edwin Allen Spomer, Peoria, AZ (US); Martin A. Martinez, Phoenix, AZ (US)

(73) Assignee: Pacific Scientific Energetic Materials Company (Arizona), LLC, Chandler, AZ (US)

( * ) Notice: Subject to any disclaimer, the term of this patent is extended or adjusted under 35 U.S.C. 154(b) by 0 days.

(21) Appl. No.: 13/420,432

(22) Filed: Mar. 14, 2012

(65) Prior Publication Data

US 2012/0237293 A1 Sep. 20, 2012

Related U.S. Application Data

(63) Continuation-in-part of application No. 13/304,132, filed on Nov. 23, 2011, now abandoned, and a continuation-in-part of application No. 12/582,703, filed on Oct. 20, 2009, now Pat. No. 8,066,446, which is a continuation-in-part of application No. 12/537,224, filed on Aug. 6, 2009, now Pat. No. 7,997,825.

(60) Provisional application No. 61/433,899, filed on Jan. 18, 2011, provisional application No. 61/195,281, filed on Oct. 6, 2008.

(51) Int. Cl.
*E01F 13/12* (2006.01)

(52) U.S. Cl.
USPC ..... 404/6

(58) Field of Classification Search
USPC ..... 404/6, 9
See application file for complete search history.

(56) References Cited

U.S. PATENT DOCUMENTS

| | | | |
|---|---|---|---|
| 3,456,920 | A | 7/1969 | Elvington |
| 4,877,660 | A | 10/1989 | Overbergh et al. |
| 5,322,385 | A | 6/1994 | Reisman |

(Continued)

FOREIGN PATENT DOCUMENTS

| | | | |
|---|---|---|---|
| CN | 1263253 | A | 8/2000 |
| CN | 2680722 | Y | 2/2005 |
| WO | WO 2009/090370 | A1 | 7/2009 |

OTHER PUBLICATIONS

International Application No. PCT/US2010/053425, International Search Report and Written Opinion, 11 pages, Dec. 13, 2010.

(Continued)

*Primary Examiner* — Raymond W Addie
(74) *Attorney, Agent, or Firm* — Perkins Coie LLP

(57) ABSTRACT

An apparatus and a method for disabling a ground engaging traction device of a land vehicle includes at least one penetrator configured to breach the traction device, an articulated strap configured to move the apparatus between a retracted arrangement and an extended arrangement, a mass configured to deploy the apparatus to the extended arrangement, and a retractor configured to retract the apparatus to the retracted arrangement. The penetrators can be arranged in a triangular section which, in turn, can be deployable on any of its three sides.

22 Claims, 27 Drawing Sheets

(56) References Cited

U.S. PATENT DOCUMENTS

| | | | |
|---|---|---|---|
| 5,330,285 | A | 7/1994 | Greves et al. |
| 5,452,962 | A | 9/1995 | Greves |
| 5,503,059 | A | 4/1996 | Pacholok |
| 5,507,588 | A | 4/1996 | Marts et al. |
| RE35,373 | E | 11/1996 | Kilgrow et al. |
| 5,775,832 | A | 7/1998 | Kilgrow et al. |
| 5,820,293 | A | 10/1998 | Groen et al. |
| 5,839,849 | A | 11/1998 | Pacholok et al. |
| 5,871,300 | A | 2/1999 | Ingham |
| 5,890,832 | A | 4/1999 | Soleau |
| 5,904,443 | A | 5/1999 | Soleau |
| 6,155,745 | A | 12/2000 | Groen et al. |
| 6,206,608 | B1 | 3/2001 | Blevins |
| 6,220,781 | B1 | 4/2001 | Miller |
| 6,224,291 | B1 | 5/2001 | Mateychuk |
| 6,322,285 | B1 | 11/2001 | Ben |
| 6,409,420 | B1 | 6/2002 | Horton et al. |
| 6,474,903 | B1 | 11/2002 | Marts et al. |
| 6,527,475 | B1 | 3/2003 | Lowrie |
| 6,551,013 | B1 | 4/2003 | Blair |
| 6,623,205 | B1 | 9/2003 | Ramirez |
| 6,716,234 | B2 | 4/2004 | Grafton et al. |
| 6,758,628 | B1 | 7/2004 | Curry, Jr. |
| 6,997,638 | B2 | 2/2006 | Hensley et al. |
| 7,011,470 | B1 | 3/2006 | Breazeale et al. |
| 7,025,526 | B2 | 4/2006 | Blair |
| 7,201,531 | B2 | 4/2007 | Shackelford et al. |
| 7,220,076 | B2 * | 5/2007 | Boll ..... 404/6 |
| 7,226,238 | B2 | 6/2007 | Collier |
| 7,441,982 | B1 | 10/2008 | Al-Sabah |
| 7,524,134 | B2 | 4/2009 | Rastegar et al. |
| 7,573,379 | B2 | 8/2009 | Moormeier et al. |
| 7,765,999 | B1 | 8/2010 | Stephens et al. |
| 7,946,785 | B2 | 5/2011 | Grosch |
| 7,997,825 | B2 | 8/2011 | Martinez et al. |
| 2005/0244223 | A1 | 11/2005 | Shackelford et al. |
| 2006/0140715 | A1 | 6/2006 | Lyddon et al. |
| 2006/0260210 | A1 | 11/2006 | Tanielian et al. |
| 2007/0264079 | A1 | 11/2007 | Martinez et al. |
| 2008/0060271 | A1 | 3/2008 | Beniamin et al. |
| 2008/0124171 | A1 | 5/2008 | Moormeier et al. |
| 2009/0163095 | A1 | 6/2009 | Weinel et al. |
| 2010/0086349 | A1 | 4/2010 | Martinez et al. |
| 2010/0196092 | A1 | 8/2010 | Castro et al. |
| 2010/0221066 | A1 | 9/2010 | Martinez et al. |

OTHER PUBLICATIONS

International Application No. PCT/US2010/053428, International Search Report and Written Opinion, 8 pages, Dec. 13, 2010.
International Application No. PCT/US2009/058892, International Search Report and Written Opinion, 10 pages, Nov. 19, 2009.
International Application No. PCT/US2009/059554, International Search Report and Written Opinion, 11 pages, Dec. 4, 2009.
Yates, Travis, "Tire Deflation Devices Help Put an End to Pursuits," PoliceOne.com News, 2 pages, Dec. 20, 2007.
International Application No. PCT/US2012/054667, International Search Report and Written Opinion, 8 pages, Nov. 23, 2012.

* cited by examiner

APPARATUS AND METHOD FOR DISABLING A GROUND ENGAGING TRACTION DEVICE OF A LAND VEHICLE

CROSS-REFERENCE TO RELATED APPLICATION(S)

This patent application is a continuation-in-part of U.S. patent application Ser. No. 13/304,132, filed Nov. 23, 2011, for "Apparatus And Method For Disabling A Ground Engaging Traction Device Of A Land Vehicle"; which claims the benefit under 35 U.S.C. §119 to U.S. Patent Application No. 61/433,899, filed Jan. 18, 2011, for "Apparatus And Method For Disabling A Ground Engaging Traction Device Of A Land Vehicle"; and is a continuation-in-part of U.S. patent application Ser. No. 12/582,703, filed Oct. 20, 2009, for "Apparatus And Method For Disabling A Ground Engaging Traction Device Of A Land Vehicle," now allowed; which is a continuation-in-part of U.S. patent application Ser. No. 12/537,224, filed on Aug. 6, 2009, entitled "Apparatus And Method For Disabling A Ground Engaging Traction Device Of A Land Vehicle," issued as U.S. Pat. No. 7,997,825 on Aug. 16, 2011; which claims the benefit under 35 U.S.C. §119 of U.S. Provisional Patent Application No. 61/195,281, filed on Oct. 6, 2008, entitled "Remotely Deployed Vehicle Restraint Device," all of which are incorporated herein in their entirety by reference.

TECHNICAL FIELD

The present disclosure relates generally to an apparatus and a method for slowing, disabling, immobilizing and/or restricting the movement of a land vehicle. More particularly, the present disclosure relates to an apparatus and a method of deploying and retracting a strap for disabling a pneumatic tire, an airless tire, an endless track, or another ground engaging traction device of a land vehicle. Certain embodiments according to the present disclosure may include an articulated strap that is pulled from a retracted arrangement to an extended arrangement. Preferably a pyrotechnic device launches a projectile that extends the articulated strap to the extended arrangements. Certain other embodiments according to the present disclosure may include a strap that is deployed by compressed gas, pressure generated by a gas generator, resilient elements, of other types of potential energy sources that can be fired multiple times without recharging. The strap includes spikes, caltrops, explosive charges, or other objects that project upwardly and are configured to penetrate a tire of a vehicle and allow the egress of air from a pneumatic tire.

BACKGROUND

Conventional devices for slowing, disabling, immobilizing and/or restricting the movement of a land vehicle include barriers, tire spike strips, caltrops, snares and electrical system disabling devices. For example, conventional spike strips include spikes projecting upwardly from an elongated base structure that is stored as either a rolled up device or an accordion type device. These conventional spike strips are tossed or thrown on a road in anticipation that an approaching target vehicle will drive over the spike strip. Successfully placing a conventional spike strip in the path of a target vehicle results in one or more tires of the target vehicle being impaled by the spike(s), thereby deflating the tire(s) and making the vehicle difficult to control such that the driver is compelled to slow or halt the vehicle.

Conventional spike strips may be used by first response personnel, law enforcement personnel, armed forces personnel or other security personnel. It is frequently the case that these personnel must remain in close proximity when deploying spike strips. For example, a conventional method of deploying a spike strip is to have the personnel toss the spike strip in the path of an approaching target vehicle. This conventional method places the security personnel at risk insofar as the driver of the target vehicle may try to run down the security personnel or the driver may lose control of the target vehicle while attempting to maneuver around the spike strip and hit the security personnel. Further, rapidly deflating only one of the steering tires may cause a target vehicle to careen wildly and possibly strike nearby security personnel, bystanders, or structures.

There are a number of disadvantages of conventional spike strips including difficulty deploying the strip in the path of a target vehicle and the risk that one of the spikes could injure security personnel while deploying or retracting the strip. The proximity of the security personnel to the target vehicle when it runs over strip places the security personnel at risk of being struck by the target vehicle. Further, allowing the strip to remain deployed after the target vehicle passes the strip places other vehicles at risk of running over the strip.

DETAILED DESCRIPTION

Specific details of embodiments according to the present disclosure are described below with reference to devices for slowing, disabling, immobilizing and/or restricting the movement of a land vehicle. Other embodiments of the disclosure can have configurations, components, features or procedures different than those described in this section. A person of ordinary skill in the art, therefore, will accordingly understand that the disclosure may have other embodiments with additional elements, or the disclosure may have other embodiments without several of the elements shown and described below with reference to the figures.

Figure 1:
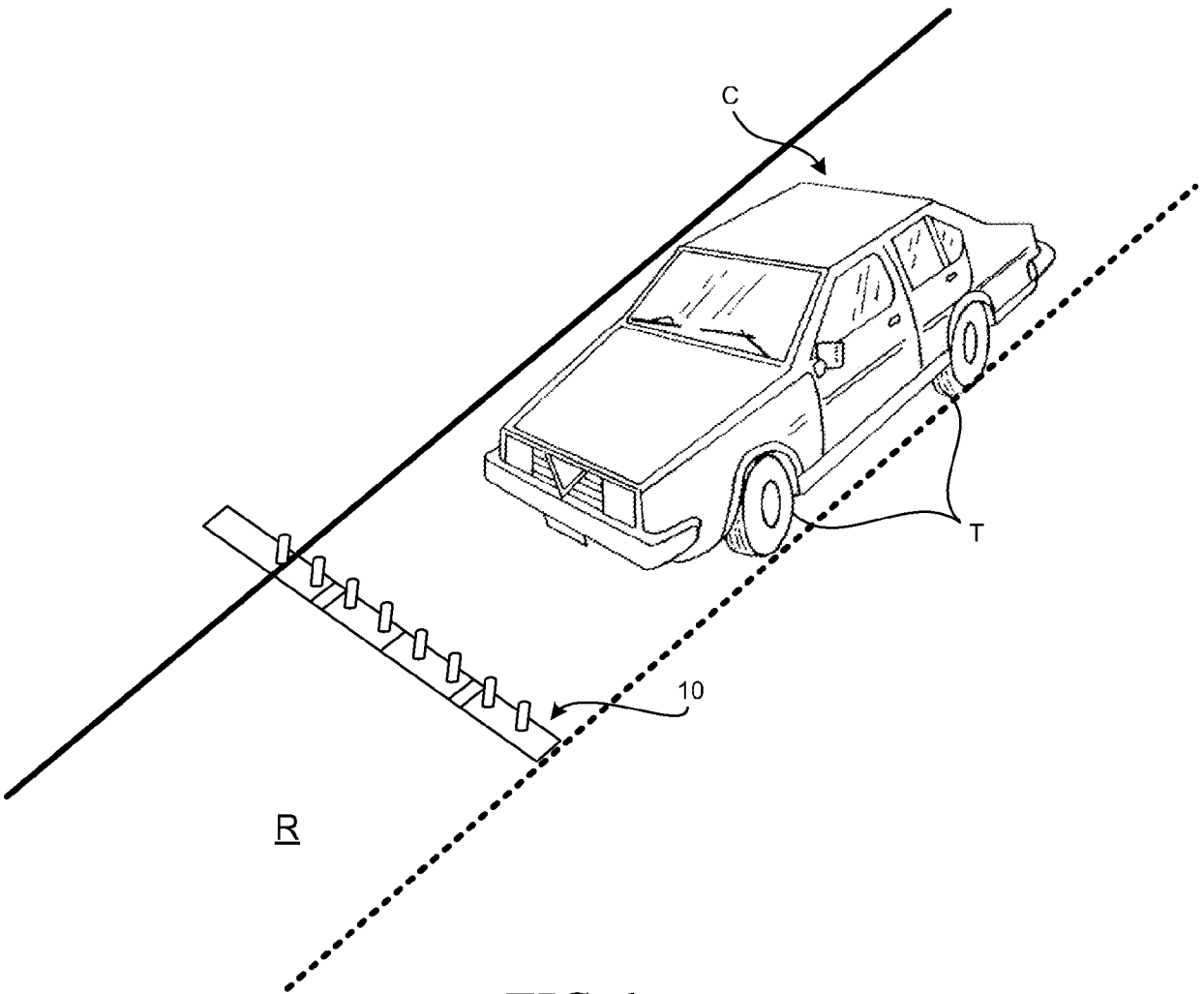
FIG. 1 is a schematic perspective view of a land vehicle approaching a device according to an embodiment of the present disclosure.

FIG. 1 is a schematic perspective view of a land vehicle approaching a device 10 according to an embodiment of the present disclosure. First response personnel, law enforcement personnel, armed forces personnel or other security personnel may use the device 10 to slow, disable, immobilize and/or restrict the movement of the land vehicle. Examples of land vehicles may include cars, trucks, tracked vehicles such as bulldozers or tanks, or any other vehicles that use pneumatic tires, airless tires, endless tracks, or other ground engaging traction devices to accelerate, steer, or support the land vehicle. The term "ground" may refer to natural or manmade terrain including improved roadways, gravel, sand, dirt, etc. FIG. 1 shows a car C supported, steered, and/or accelerated by pneumatic tires T relative to an improved roadway R.

Certain embodiments according to the present disclosure deploy the device 10 in the expected pathway of a target vehicle, e.g., the car C. The undeployed device 10 may be placed on the ground, e.g., on or at the side of the road R, and then armed. For example, the device 10 can be armed by making a power source available in anticipation of deploying the device 10. The device 10 is deployed, e.g., extended across the expected pathway of the target vehicle, as the vehicle approaches the device 10. The device 10 may be deployed when the target vehicle is a short distance away, e.g., less than 100 feet. This may avoid alerting the driver to the presence of the device 10 and thus make it more likely that the target vehicle will successfully run over the device 10. Similarly, remotely or automatically deploying the device 10 may reduce the likelihood that the driver will notice the device 10 or take evasive action to avoid running over the device 10. Remotely deploying the device 10 also allows the device operator (not shown) to move away from the target vehicle and thereby reduce or eliminate the likelihood of the vehicle striking the operator.

Figure 2A:
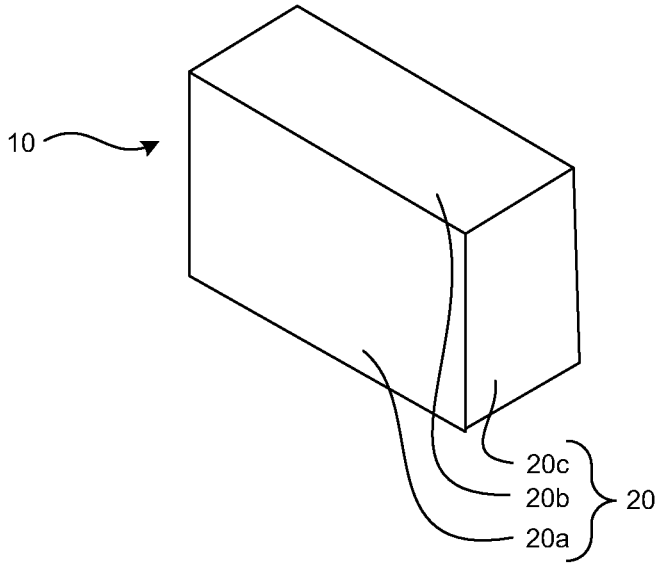
FIGS. 2A-2D are schematic perspective views showing a device according to an embodiment of the present disclosure in an unarmed arrangement, an armed arrangement, and a deployed arrangement, respectively.
Figure 2B:
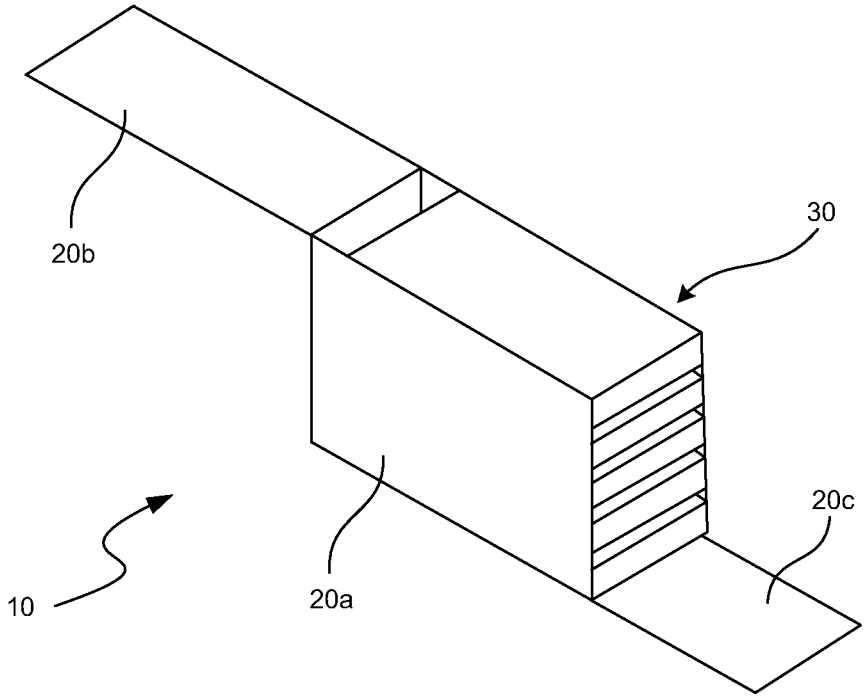
Figure 2C:
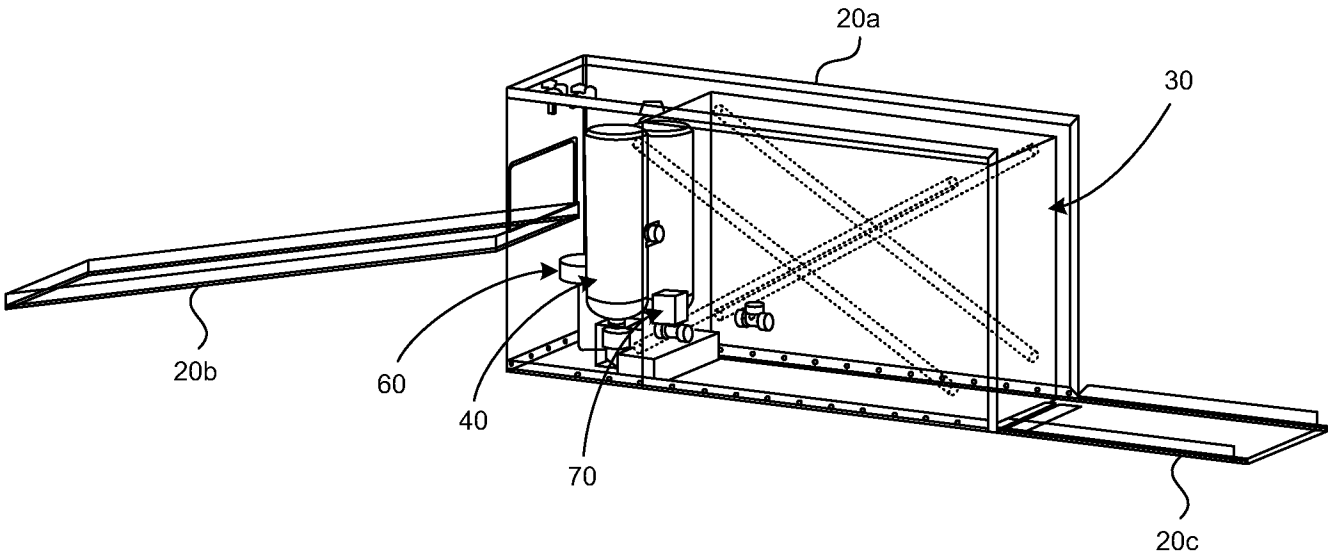
Figure 2D:
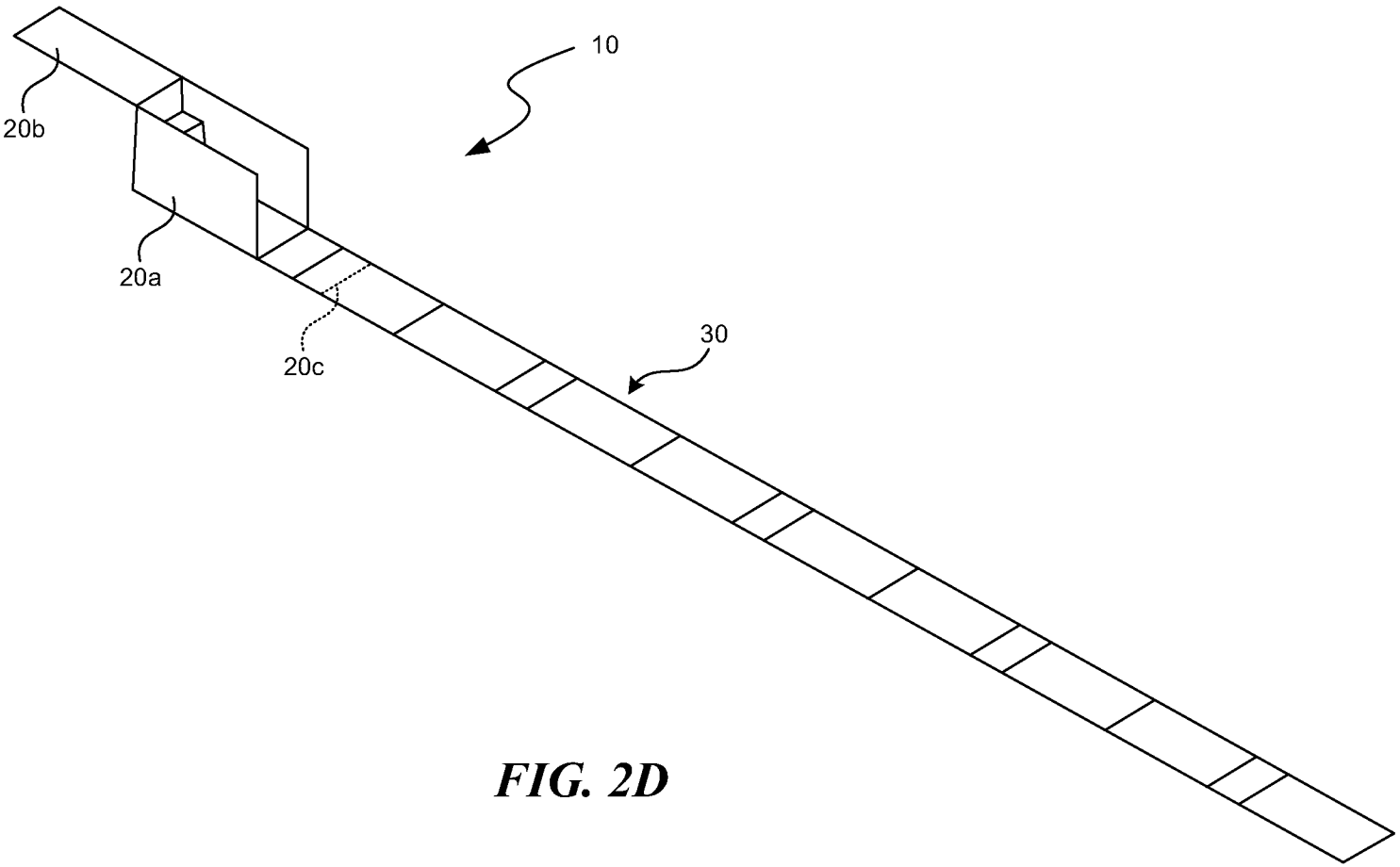

FIGS. 2A-2D are schematic perspective views showing the device 10 in an undeployed arrangement (FIG. 2A), an armed arrangement (FIGS. 2B and 2C), and a deployed arrangement (FIG. 2D). FIG. 2A shows an embodiment according to the present disclosure including a housing 20 for storing, transporting and/or handling the device 10 in the undeployed arrangement. In particular, the housing 20 may include a bottom portion 20*a* coupled to a top portion 20*b* and a front portion 20*c* in a box type configuration. In some embodiments, an ammunition box type can be used. Opening the housing 20 (FIG. 2B) and/or another action, e.g., tripping a switch, may arm the device 10. FIG. 2C is a partially transparent view showing a strap package 30, an inflation device 40, a retractor device 60, and a power source 70, e.g., a battery pack, according to an embodiment of the present disclosure with the housing 20 opened. Once armed, the device 10 is ready to be deployed. As the target vehicle approaches the device 10, the strap package 30 is deployed (FIG. 2C) such that the strap package 30 is unfolded or unfurled in the expected path of the target vehicle. According to one embodiment of the present disclosure, the dimensions of the housing 20 can be approximately 8" wide, approximately 14" tall, and approximately 28" long in the undeployed arrangement (FIG. 2A). The weight of the device 10 can be approximately 40 pounds and the housing 20 can be painted olive drab, similar to an ammunition box. In another embodiment, the dimensions of housing 20 can be approximately 20" tall, 13" wide and 7" long, and the total weight can be 25 lbs. For this embodiment, the length of deployed device 10 can be about 18 ft.

Figure 3A:
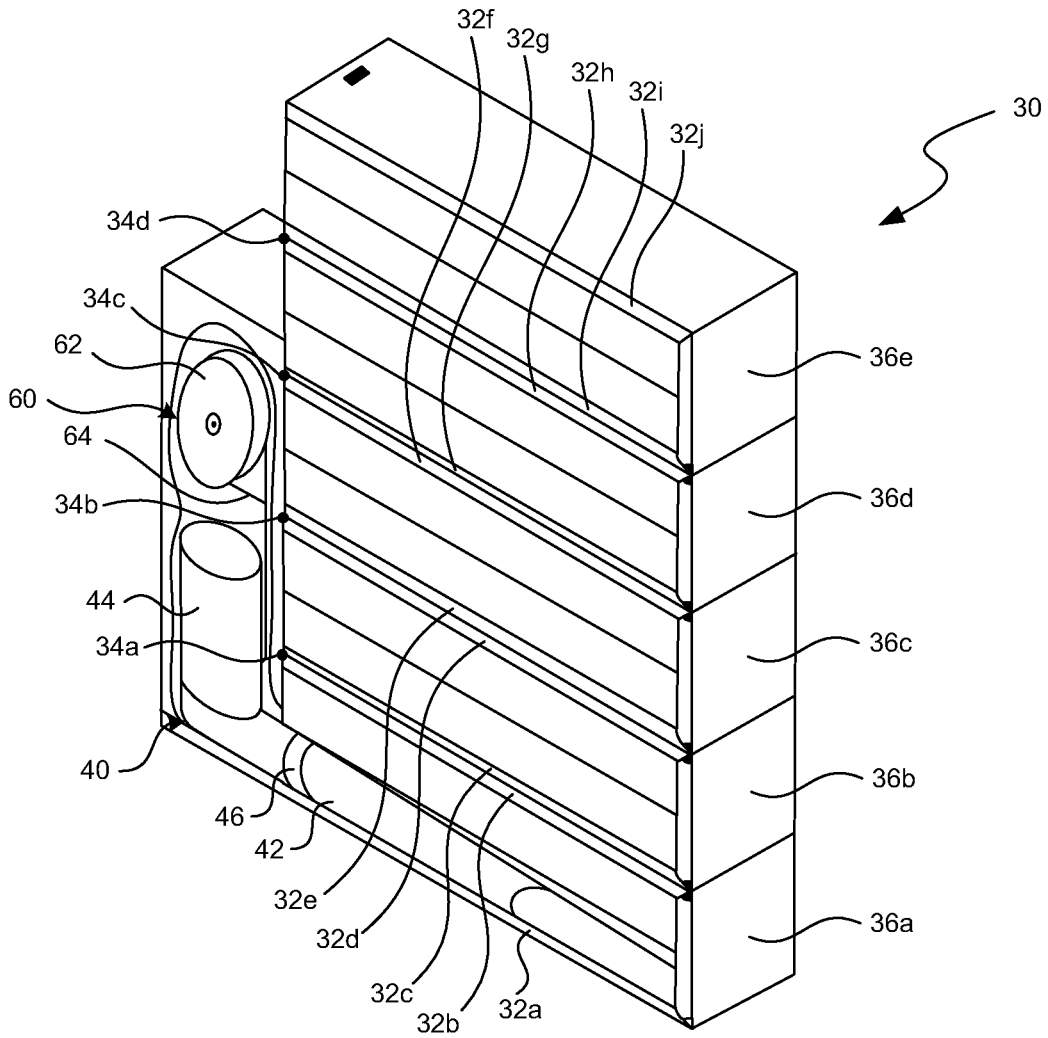
FIG. 3A is a perspective view of a strap package including an inflator device and a retractor device according to an embodiment of the present disclosure before the device is deployed.

FIG. 3A is a perspective view of the strap package 30 including the inflator device 40 and the retractor device 60 according to an embodiment of the present disclosure before the device 10 is deployed. The strap package 30 includes a plurality of plates 32 (ten plates 32*a*-32*j* are shown in FIG. 3A) that are pivotally coupled by alternating first and second joints. Individual first joints 34 (four first joints 34*a*-34*d* are shown in FIG. 3A) include a single pivot axis between adjacent plates 32, and individual second joints 36 (five second joints 36*a*-36*e* are shown in FIG. 3A) include two separate pivot axes spaced by a link between adjacent plates 32. According to the embodiment shown in FIG. 3A, second joint 36*a* pivotally couples plates 32*a* and 32*b*, first joint 34*a* pivotally couples plates 32*b* and 32*c*, second joint 36*b* pivotally couples plates 32*c* and 32*d*, first joint 34*b* pivotally couples plates 32*d* and 32*e*, second joint 36*c* pivotally couples plates 32*e* and 32*f*, first joint 34*c* pivotally couples plates 32*f* and 32*g*, second joint 36*d* pivotally couples plates 32*g* and 32*h*, first joint 34*d* pivotally couples plates 32*h* and 32*i*, and second joint 36*e* pivotally couples plates 32*i* and 32*j*. Accordingly, the strap package 30 includes an articulated series of plates 32 and joints 34 and 36. The second joints 36 may alternatively be viewed as "shorter" plates with individual pivot axes that couple the shorter plates to adjacent "longer" plates 32.

The undeployed or stacked arrangement of the strap package 30 shown in FIG. 3A includes the plates 32*a* through 32*j* overlying one another. In particular, plate 32*j* overlies plate 32*i* (they are separated by second joint 36*e*), plate 32*i* directly overlies plate 32*h* (they are coupled by first joint 34*d*), plate 32*h* overlies plate 32*g* (they are separated by second joint 36*d*), plate 32*g* directly overlies plate 32*f* (they are coupled by first joint 34*c*), plate 32*f* overlies plate 32*e* (they are separated by second joint 36*c*), plate 32*e* directly overlies plate 32*d* (they are coupled by first joint 34*b*), plate 32*d* overlies plate 32*c* (they are separated by second joint 36*b*), plate 32*c* directly overlies plate 32*b* (they are coupled by first joint 34*a*), and plate 32*b* overlies plate 32*a* (they are separated by second joint 36*a*). The spaces between the plates 32 due to the separation provided by the second joints 36 accommodate penetrators that are coupled to the plates 32 as will be discussed in greater detail below.

The plates 32 and/or the second joints 36 can include fiberglass, corrugated plastic or cardboard, wood, or another material that is suitably strong and lightweight. For example, G10 is an extremely durable makeup of layers of fiberglass soaked in resin that is highly compressed and baked. Moreover, G10 is impervious to moisture or liquid and physically stable under climate change. The plates 32 provide a platform suitable for delivering the spikes, caltrops, explosive charges, etc. that penetrate a tire of a target vehicle. Accordingly, the size and shape of the plates 32 may be selected to provide adequate support on lose or unstable ground, e.g., sand. For example, a six-inch by 17.5 inch plate made from 1/32 inch thick G-10 can provide a suitable platform. The size of the plates 32 may also affect how far the strap package 30 extends in the deployed arrangement, e.g., shorter plates 32 may result in a shorter strap package 30 being deployed.

Figure 4:
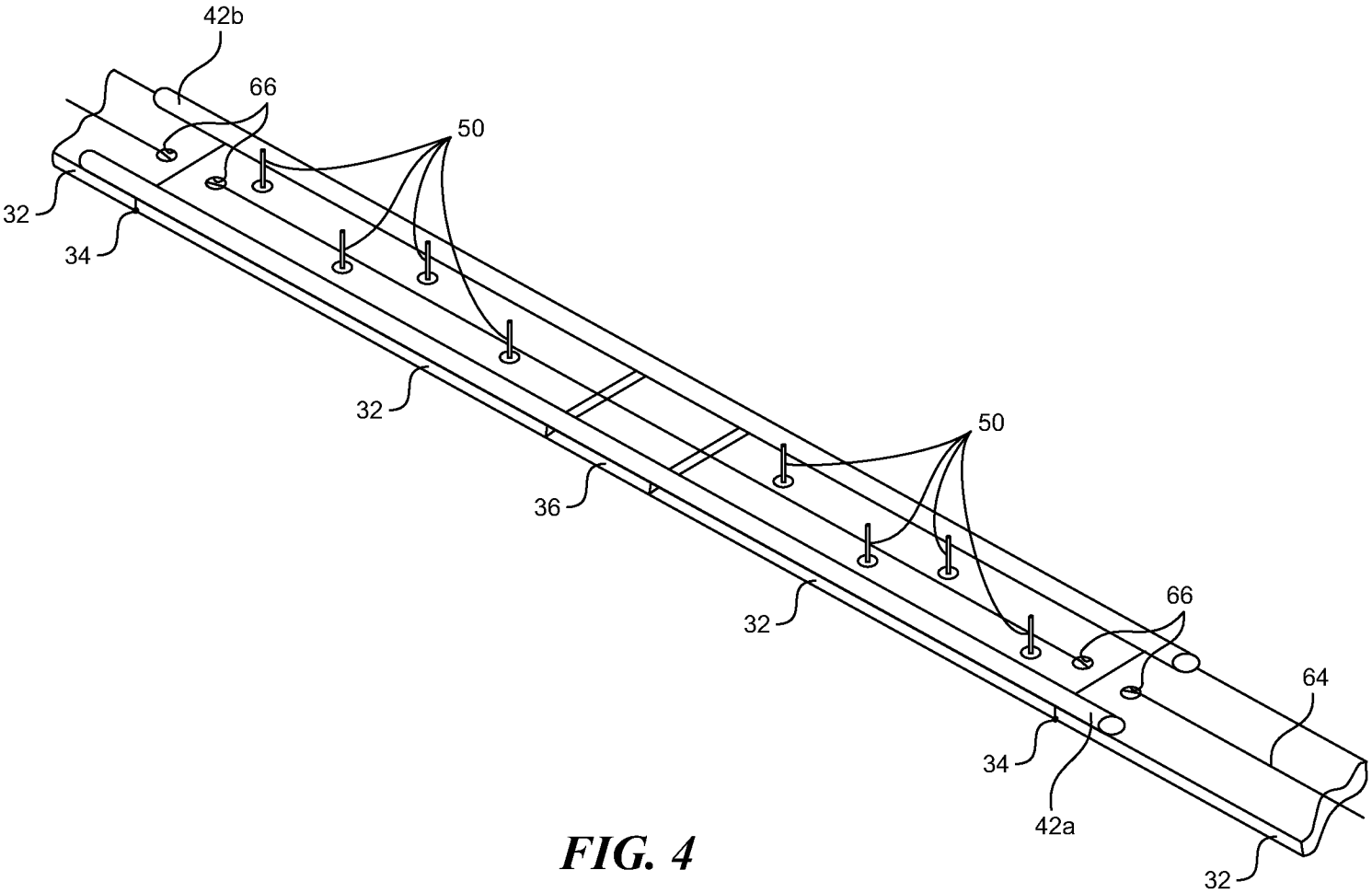
FIG. 4 is a detail view of a portion of the strap package of FIG. 3 after the strap package is deployed.

The inflator device 40 includes inflatable bladders 42 (two inflatable bladders 42*a* and 42*b* are shown in FIG. 4) that are also accommodated in the spaces between the plates 32 due to the separation provided by the second joints 36. The inflator device 40 additionally includes a pressure source 44, e.g., a pressurized gas cylinder, gas generator, an accumulator, etc., and a manifold 46 coupling the pressure source 44 to the bladders 42. The bladders 42 are mounted to the plates 32 and, in response to being inflated by the pressure source 44, expand to deploy the strap package 30. Certain embodiments according to the present disclosure include tubular bladders 42 mounted lengthwise along the plates 32 such that, in the stacked arrangement of the strap package 30, the bladders 42 are temporarily creased at the first and second joints 34 and 36. Accordingly, each bladder 42 defines a series of chambers that may be sequentially inflated starting at the end of the bladder 42 coupled to the manifold 46. As each chamber is inflated, the expanding bladder unstacks, e.g., unfolds, unfurls, or otherwise begins to deploy, adjacent overlying plates 32 until the bladders 42 are approximately fully expanded and the strap package is deployed, e.g., as shown in FIG. 2C. The pivot axes of the first and second joints 34 and 36 may assist in constraining the strap package 30 to deploying in a plane, e.g., minimizing or eliminating twisting by the strap package 30 about its longitudinal axis when it is being deployed.

The inflator device 40 may also include a sensor (not shown) for sensing an approaching vehicle and automatically deploying the strap package 30. Examples of suitable sensors may include magnetic sensors, range sensors, or any other device that can sense an approaching vehicle and deploy the strap package 30 before of the vehicle arrives at the device 10. The inflator device 40 may alternatively or additionally include a remote actuation device (not shown) for manually deploying the strap package 30. The sensor and/or the remote actuation device may be coupled to the device 10 by wires, wirelessly, or another communication system for conveying a "deploy signal" to the device 10. Examples of wireless communication technology include electromagnetic transmission (e.g., radio frequency) and optical transmission (e.g., laser or infrared).

Figure 3B:
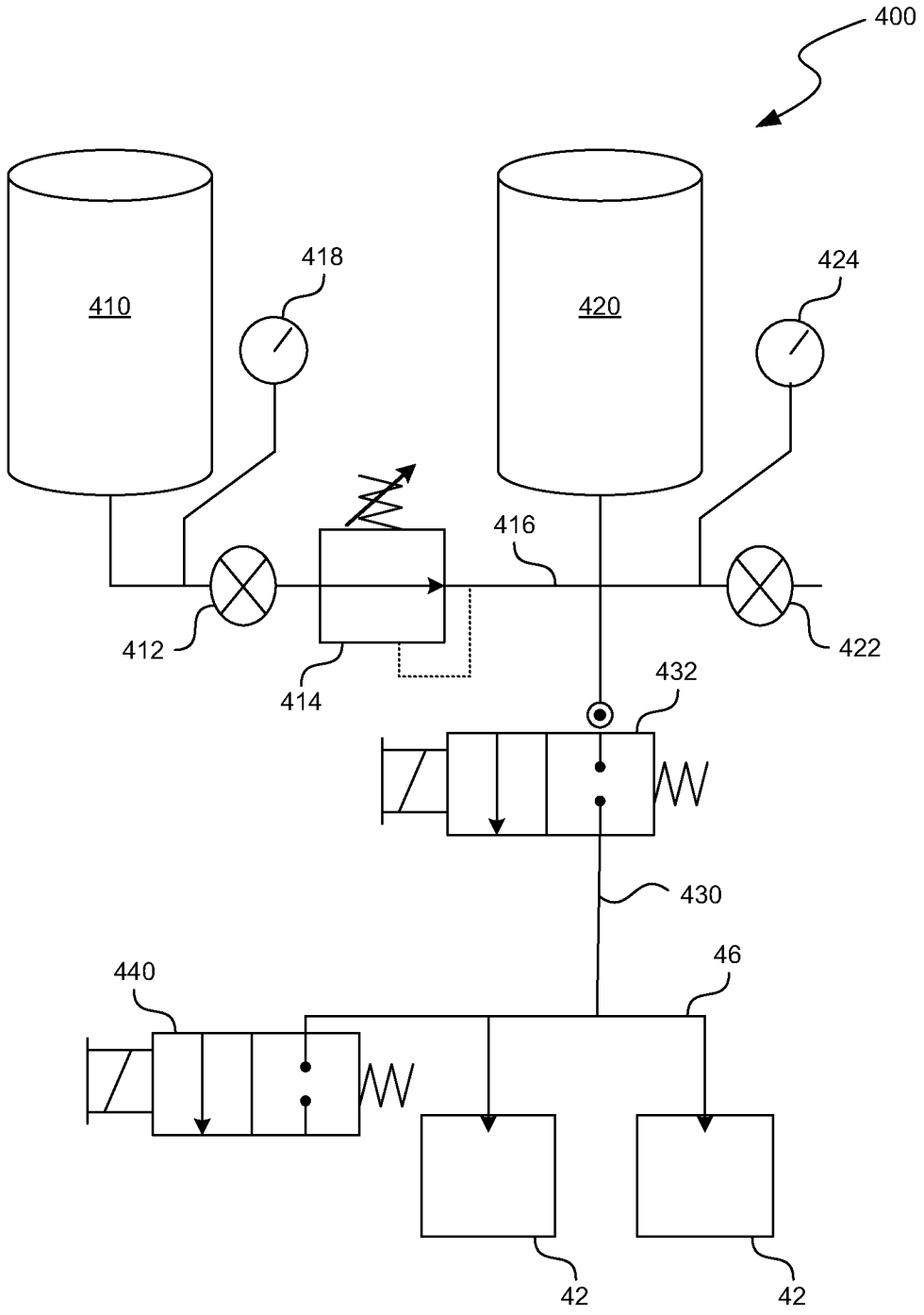
FIG. 3B is a schematic view of an inflator device according to an embodiment of the present disclosure.

FIG. 3B is a schematic view of a multiple discharge, cold gas inflator device 400 according to an embodiment of the present disclosure. The inflator device 400 shown in FIG. 3B includes a high pressure reservoir 410 for supplying a compressed gas, e.g., nitrogen, to an accumulator tank 420. The supply of compressed gas can be controlled by a supply valve 412 and/or a pressure regulator 414 along a supply line 416 coupling the high pressure reservoir 410 and the accumulator tank 420. The supply valve 412 can supply or shutoff a flow of the compressed gas from the high pressure reservoir 410 through the supply line 416. According to certain embodiments of the present disclosure, the high pressure reservoir 410 can have a volume of approximately 50 cubic inches ($in^3$) and can be initially pressurized to approximately 3,000 pounds per square inch (psi). The accumulator tank 420 can have a volume less than, similar to, or greater than that of the high pressure reservoir 410. For example, certain embodiments of the present disclosure can include an accumulator tank 420 having a slightly larger volume, e.g., approximately 62 $in^3$, and the pressure regulator 414 can be adjusted to pressurize the accumulator tank 420 to a relatively lower pressure, e.g., to approximately 600 psi. In general, the volume and pressure of the accumulator tank 420 may be related to the volume of the bladders 42 and the desired time for deploying the strap package 30 with the bladders 42. For example, greater deployment pressure and/or volume may reduce the time it takes to deploy the strap package 30 whereas lower deployment pressure and/or volume may provide a more controlled deployment of the strap package 30. A gauge 418 can be coupled to the supply line 416 between the high pressure reservoir 410 and the supply valve 412 to indicate the pressure in the high pressure reservoir 410. Certain other embodiments may use a different gas or mixture of gases, may include reservoirs or tanks with different volume(s), may include fixed or adjustable pressure regulators, and/or may use different pressure(s).

A drain valve 422 coupled to the supply line 416 downstream of the accumulator tank 420 can drain residual pressure in the accumulator tank 420 by opening the supply line 416 to the atmosphere. A gauge 424 can be coupled to the supply line 416 between the supply valve 412 and the drain valve 422 to indicate the pressure in the accumulator tank 420.

Compressed gas for deploying the strap package 30 can flow along a deployment line 430 that couples the supply accumulator tank 420 and the manifold 46. A deployment valve 432 is positioned along the deployment line 430 between the supply accumulator tank 420 and the manifold 46 to control flow of the compressed gas to the strap package 30. According to certain embodiments of the present disclosure, the deployment valve 432 can include a 0.5 inch NPT normally closed solenoid valve with an approximately 15 millimeter orifice, a 1500 psi pressure capability, and can be actuated by a direct current signal, e.g., 24 volts. A signal to deploy the strap package 30 energizes the solenoid of the deployment valve 432 to allow compressed gas in the accumulator tank 420 to flow through the deployment line 430 and the manifold 46 to the bladders 42, thereby deploying the strap package 30. A vent valve 440 coupled to the deployment line 430 downstream of the deployment valve 432 and/or coupled to the manifold 46 can vent compressed gas in the bladders 42 to the atmosphere. According to certain embodiments of the present disclosure, the vent valve 440 can include a 0.125 inch NPT normally closed solenoid valve with an approximately 1.2 millimeter orifice and can also be actuated by a 24 volt direct current signal. A signal to vent the bladders 42 energizes the solenoid of the vent valve 440 to release to atmosphere the gas in the bladders 42, for example, before and/or during operation of the retractor device 60.

Figure 3C:
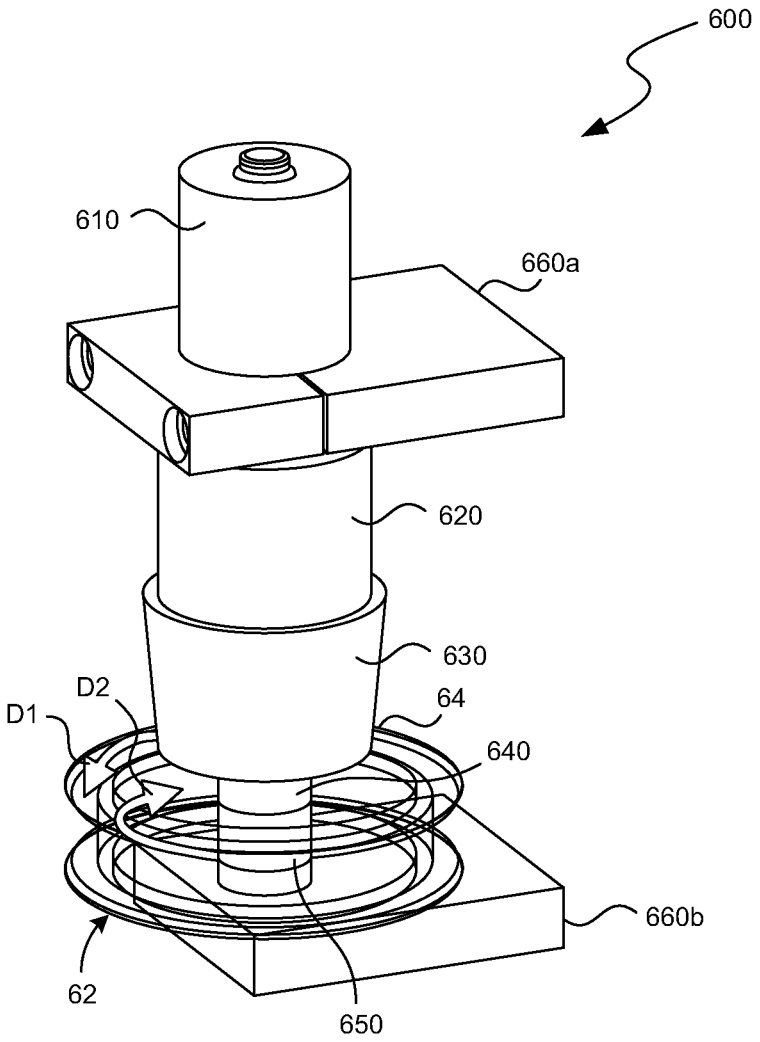
FIG. 3C is a detail view showing a retractor device according to an embodiment of the present disclosure.

FIG. 3C is a perspective view of a retractor device 600 according to an embodiment of the present disclosure. The retractor device 600 may be electrically, pneumatically, mechanically (e.g., with a resilient element such as a torsion spring), or otherwise powered. The retractor device 600 shown in FIG. 3C includes a torque source 610, e.g., an electric motor, a torque multiplier 620, e.g., reduction gearing, a torque limiter 630, e.g., a friction plate slip-clutch, a coupling 640, and a one-way clutch 650, e.g., a drawn cup needle clutch bearing. One or more brackets 660 (two brackets 660*a* and 660*b* are shown in FIG. 3C) may support the retractor device 600 with respect to the housing 20. Certain embodiments of the retractor device 600 can include a 60-80 Watt direct current electric motor 610 rated at 3000 revolutions per minute and a 6:1 ratio planetary gear reducer 620. The coupling 640 can be a steel mandrel for transferring driving torque to a drive pulley 62 for winding a cable 64 on the drive pulley 62. An example of a drawn cup needle clutch bearing is part number RC-081208 manufactured by The Timken Company of Camden, Ohio. The one-way clutch 650 may be interposed between the coupling 640 and the drive pulley 62. Accordingly, operating the torque source 610 engages the one-way clutch 650 thereby driving the drive pulley 62 and winding the cable 64 onto the drive pulley 62 to retract the strap package 30. Moreover, the one-way clutch 650 allows the drive pulley 62 to turn generally freely to allow the cable 46 to pay-out when, for example, the strap package 30 is being deployed.

The electronics for the control of the device 10 can include at least two options for triggering deployment: (1) a wireless frequency operated button ("FOB") and/or (2) a wired control box. Embodiments of option 1 according to the present disclosure can include a three-channel, 303 MHz wireless radio frequency board (e.g., Model Number RCR303A manufactured by Applied Wireless, Inc. of Camarillo, Calif.) in the housing 20 and a three-button FOB (e.g., Key Chain Transmitter KTX303Ax also manufactured by Applied Wireless, Inc.) that can be separated and remotely located from the housing 20. Some other embodiments use radio frequency transmission equipment having a LINX RXM-418-LR 418 MHz receiver, CMD-KEY#-418-S5 transmitter, and LINX LICAL-DEC-MS001 decoder (which decodes the encrypted digital string sent by the transmitter). The wireless transmissions can be encoded at 24 bits (allowing for 16.7 million unique addresses) to negate the possibility of cross-talk between another nearby unit. Embodiments of option 2 according to the present disclosure can include a control box that can be separated and remotely located from the housing 20 but remains electrically coupled via a cable. Both options may be incorporated into the device 10 to provide a backup for controlling deployment of the strap package 30.

Figure 3D:
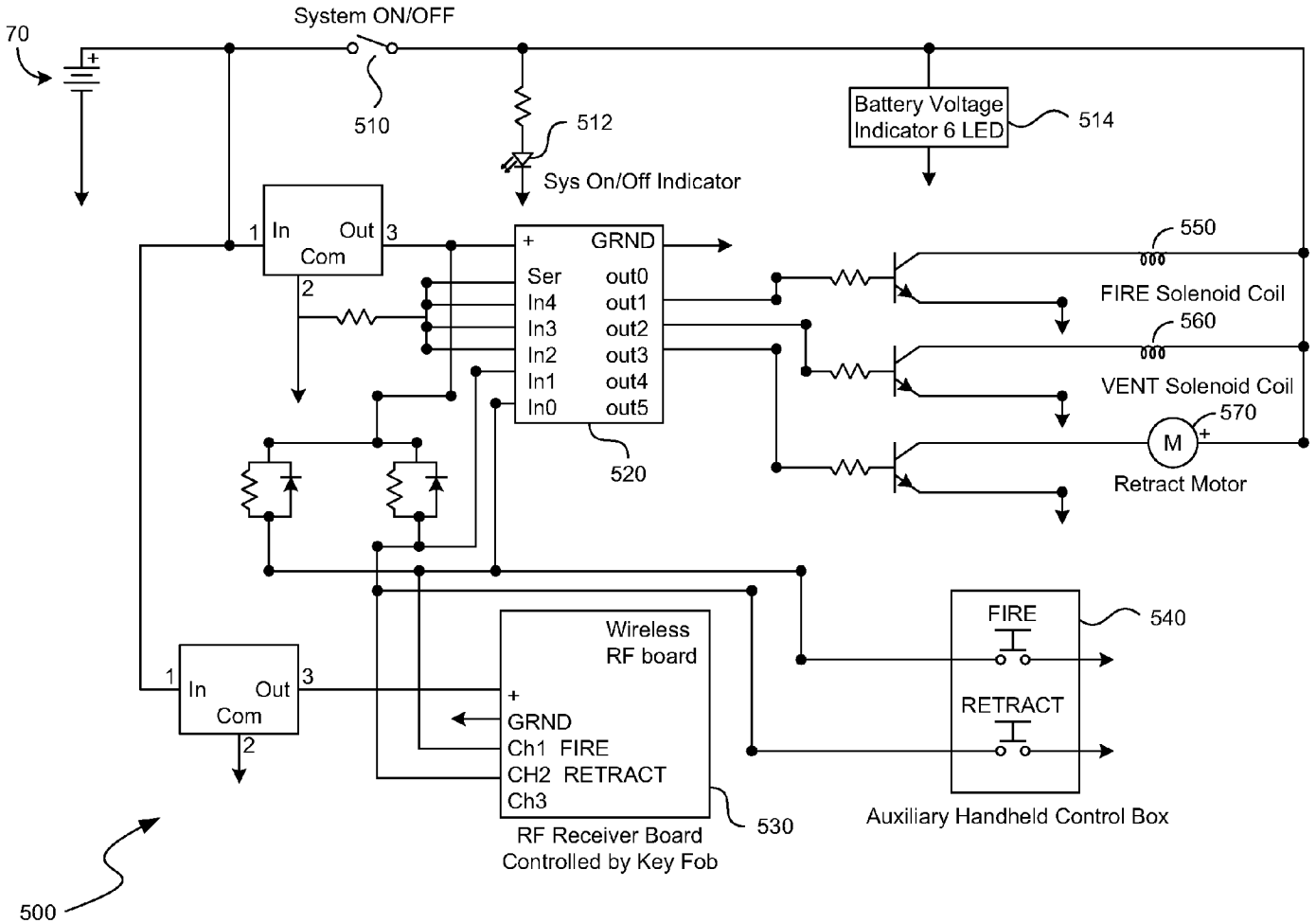
FIG. 3D is a schematic diagram showing a control system according to an embodiment of the present disclosure.

FIG. 3D is a schematic diagram of an electronic circuit 500 for controlling the inflator device 400 and the retractor device 600 according to an embodiment of the present disclosure. The electronic circuit 500 shown in FIG. 3D includes the power supply 70, e.g., a 24 volt direct current battery, and a system switch 510 for turning ON/OFF the device 10. The electronic circuit 500 may also include a first indicator 512 for showing the status of the device 10 based on the setting of the system switch 510 and a second indicator 514 for showing the voltage of the power supply 70. A microprocessor 520 receives input signals, e.g., "FIRE" and "RETRACT," from a wireless radio frequency board 530 (i.e., option 1) and/or an auxiliary handheld control box 540 (i.e., option 2) and sends output signals to (a) a solenoid coil 550 for the deployment valve 432, (b) a solenoid coil 560 for the vent valve 440, and/or (c) a motor winding 570 for the torque source 610.

The electronic circuit 500 can also include circuitry to handle the timing and control of operational events. Such a circuit may be useful if, for example, there is a difference in voltage provided by the wired control box 540 (e.g., approximately 14-17 volts direct current) verses the voltage required to operate the deployment valve 432 and/or vent valve 440 (e.g., approximately 24 volts direct current). This other circuit operates based on operator input for each event from either the wireless radio frequency board 530 (i.e., option 1) and/or the wired control box 540 (i.e., option 2).

Figure 3E:
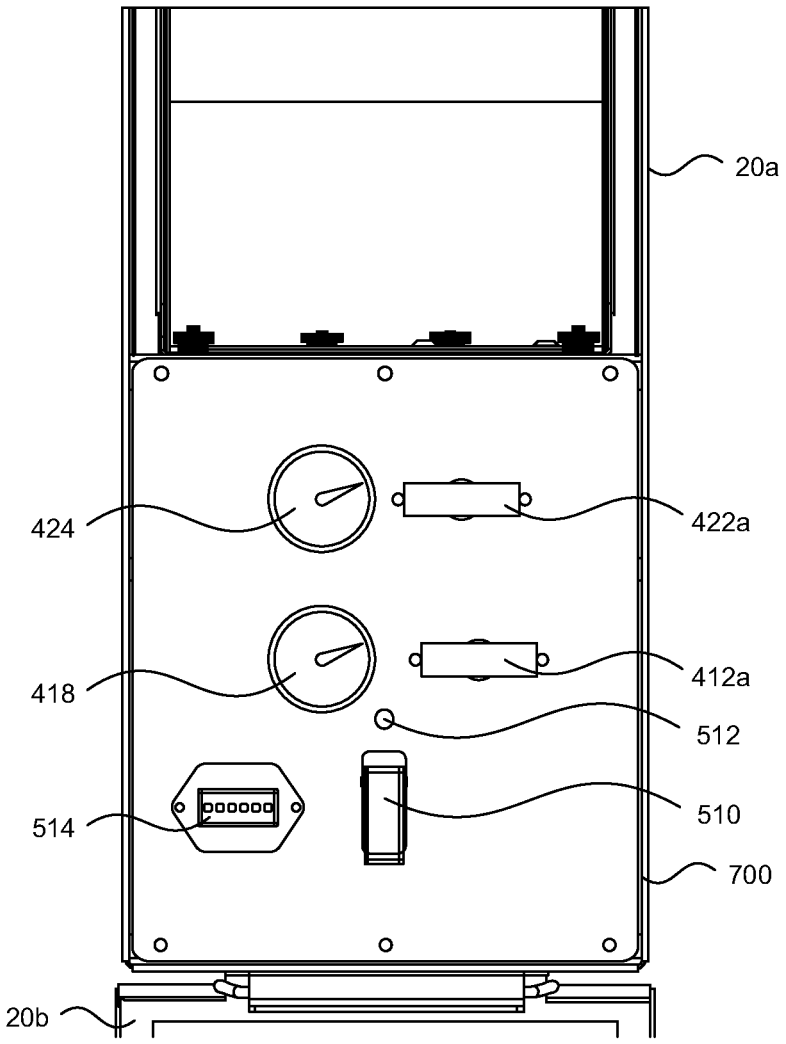
FIG. 3E is a partial plan view showing a control panel according to an embodiment of the present disclosure.

FIG. 3E is a partial plan view showing a control panel 700 according to an embodiment of the present disclosure. The control 700 can be coupled to the housing 20 and include the gauge 418 to indicate the pressure in the high pressure reservoir 410, the gauge 424 to indicate the pressure in the accumulator tank 420, the second indicator 514 for showing the voltage of the power supply 70, the system switch 510, the first indicator 512 for showing the ON/OFF status of the device 10 based on the setting of the system switch 510, a knob 412*a* operating the supply valve 412 to supply or shutoff the flow of the compressed gas from the high pressure reservoir 410, and a knob 422*a* operating the drain valve 422 to drain residual pressure in the accumulator tank 420 and purge the inflator device 400, for example, when storing the device 10.

FIG. 4 is a detail view of a portion of the strap package 30 after being deployed. As the target vehicle drives onto or over the deployed strap package 30, the tires of the target vehicle will engage penetrators 50, e.g., hollow spikes, barbs, hooks or other devices for penetrating and deflating a pneumatic tire. The number and distribution of penetrators 50 on the plates 32 can be varied as desired; however, increasing the number of penetrators 50 and/or decreasing the relative spacing between penetrators 50 are believed to increase the likelihood that at least one of the tires of the target vehicle will be impaled.

The penetrators 50 may alternately or additionally include one or more explosive charges (not shown). These charges, e.g., shaped charges such as linear shape charges, are suitable for rupturing or otherwise severing the tread or other components of pneumatic tires, airless tires, endless tracks, and/or other ground engaging traction devices of land vehicles. Such explosive charges may be triggered in response to sensing the weight of the target vehicle following deployment of the strap package 30, e.g., as described above. Certain embodiments of the penetrators 50 according to the present disclosure can include independent shaped charges and/or elongated linear shape charges that extend along individual plates 32. Moreover, the penetrators 50 can include combinations of spikes and charges. In operation, only the penetrators 50 that are engaged by the target vehicle are activated, e.g., spikes are picked up, charges explode, etc.

Certain embodiments according to the present disclosure may include hollow spikes to puncture and deflate pneumatic tires. Deflating one or more of the tires may cause the vehicle to become more difficult to control, e.g., deflating a tire used for steering may limit or prevent the ability of the target vehicle to maneuver and/or deflating a tire used for driving the target vehicle may limit or prevent accelerating or braking. Hollow spikes can be pulled from a spike holder (not shown in FIG. 4) on a plate 32 after the spikes contact and penetrate the tire. The hollow spike will then allow air in the tire to escape. The rate at which air escapes can be relatively rapid, e.g., with unimpeded air flow through the hollow spike, or relatively slow, e.g., with a valve or other flow restrictor (not shown) in the hollow spike.

Referring to FIGS. 3C and 4, the retractor device 60 includes the drive pulley 62 for winding in the cable 64. The retractor device 60 may be electrically, pneumatically, mechanically (e.g., with a resilient element such as a torsion spring), or otherwise powered. The cable 64 may alternatively or additionally include a monofilament line, a tape, or another suitable flexible tension device for retracting the strap package 30 from the deployed arrangement shown in FIG. 2C. Certain embodiments according to the present disclosure include the cable 64 running along the plates 32 and the second joints 36 in the stacked arrangement shown in FIG. 2B. The cable 64 is secured at one end to the winch 62, extends through holes 66, e.g., possibly lined by grommets (not shown), in the plates 32, and is secured at the other end to plate 32*j*. The holes 66 may be positioned proximate to the first joints 34. Accordingly, the cable 64 does not impede deploying the strap package 30 and draws the plates 32 into a retracted arrangement that is akin to the stacked arrangement of the plates 32 before they are deployed. A difference between the retracted and stacked arrangements is that the winch 62 has wound-in the cable 64 in the retracted arrangement. The retractor device 60 is used to retract the strap package 30 from the deployed arrangement shown in FIG. 2C under a variety of circumstances including, e.g., after the target vehicle has run over the device 10 but before a pursuit vehicle runs over the device 10 or after a predetermined time period has elapsed following an automatic deployment without a target vehicle running over the device 10. Certain embodiments of the retractor 600 according to the present disclosure may include a clutch, lock-release mechanism, and/or one way clutch 650 that allows the cable 64 to be freely unwound so that the plates 32 can be restacked and the cable 64 can be restrung for subsequent re-deployment. Certain other embodiments according to the present disclosure may include a cutting device for severing the cable 64 in the retracted arrangement. This would allow a secondary deployment of the device 10 even though the retractor 60 would not be able to retract the device 10 following the secondary deployment.

Figure 5A:
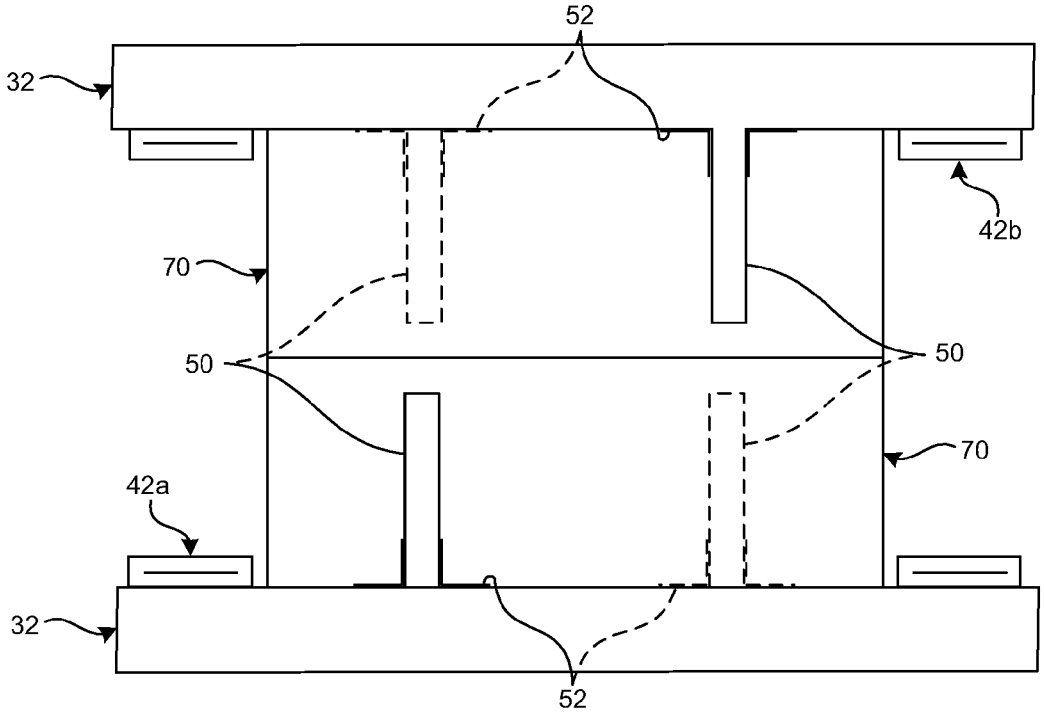
FIGS. 5A and 5B are cross-section views of devices according to embodiments of the present disclosure showing foam spike protectors.
Figure 5B:
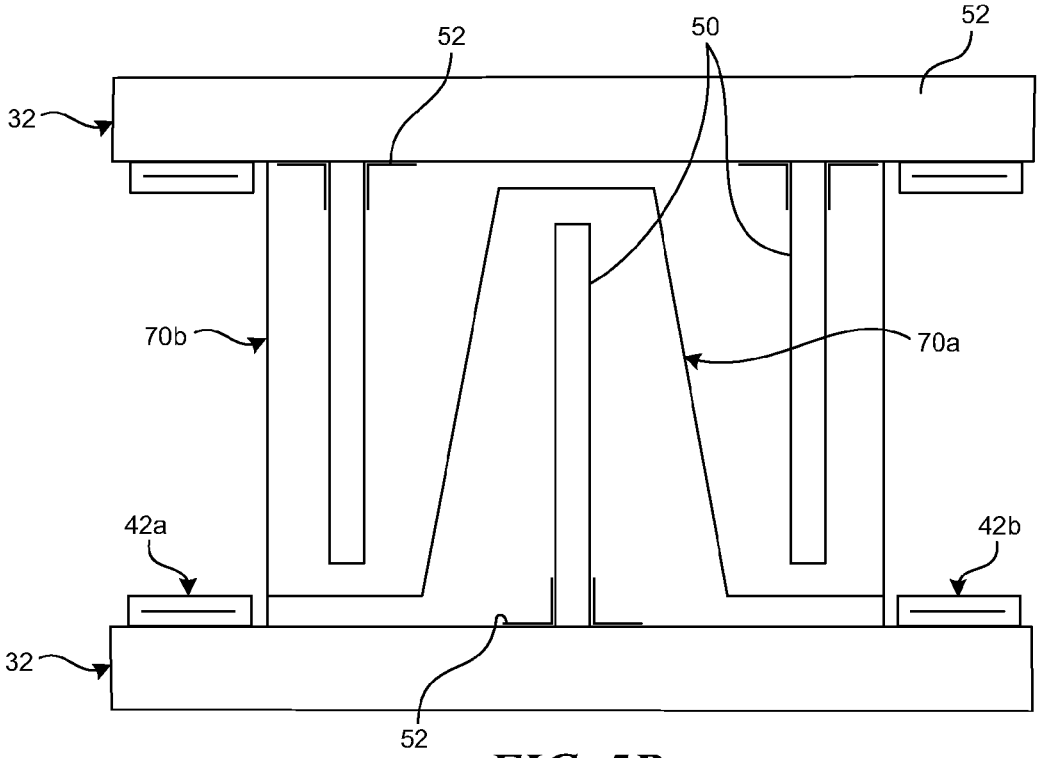

FIGS. 5A and 5B are cross-section views of the devices 10 including foam spike protectors 70. Deploying the strap package 30 involves flinging the plates 32 with the sharpened penetrators 50. The foam protectors 70 may reduce or prevent incidental contact with the penetrators 50. FIG. 5A shows an embodiment including blocks of foam, e.g., expanded polystyrene (EPS), coupled to the plates 32 so as to approximately encase the penetrators 50. Foams such as EPS are suitable materials because they are lightweight and they do not appreciably interfere with the penetrator 50 impaling a tire because the foam is readily crushed by the target vehicle. Other materials and configurations presenting similar characteristics may alternatively or additionally be used. FIG. 5B shows an alternative configuration in which interlocking foam protectors 70*a* and 70*b* are coupled to the adjacent plates 32 to either side of the second joints 36. The configuration shown in FIG. 5B allows longer penetrators 50 to be supported by the plates 32 as compared to the configuration shown in FIG. 5A. As discussed above, the plates 32 provide a support platform for the penetrators 50, even when the device is deployed on lose or unstable ground.

An additional advantage of the protectors 70 is retaining the penetrators 50 in holders 52 mounted on the plates 32. Accordingly, the protectors 70 can prevent the penetrators 50 from being prematurely released from the holders 52, e.g., before a tire of a target vehicle is impaled on one or more of the penetrators 50. Certain embodiments according to the present disclosure include penetrators 50 and/or holders 52 that are retained against or in contact with a plate 32. The penetrator 50 may be a hollow spike having a barbed tip that penetrates a pneumatic tire. Such a penetrator 50 may then be pulled from the holder 52 to allow air in the tire to exhaust through the hollow spike interior.

Figure 6:
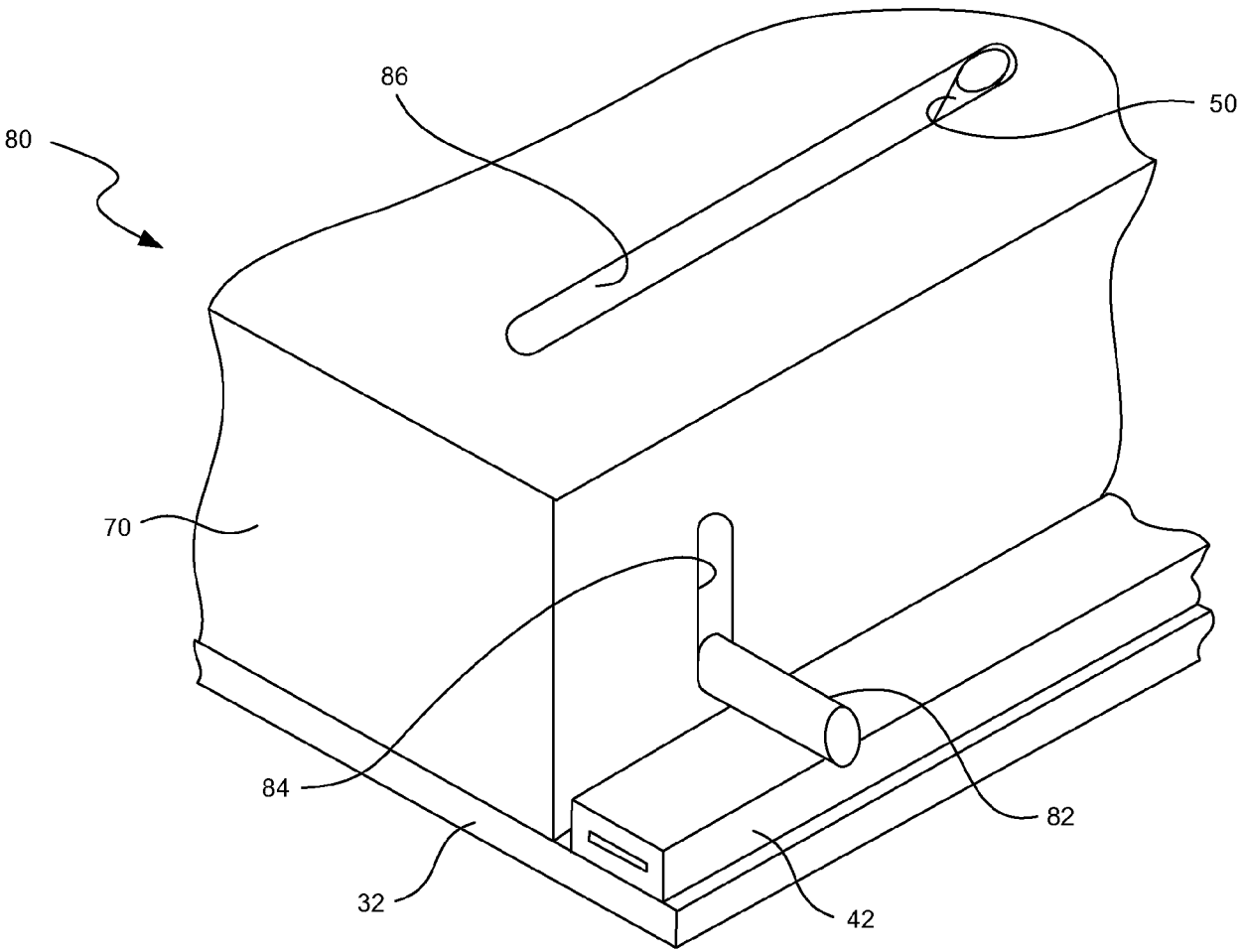
FIG. 6 is a partial perspective view of a device according to an embodiment of the present disclosure including a spike erector.

FIG. 6 is a partial perspective view of the device 10 including a spike erector 80. As was described with respect to FIG. 5B, longer penetrators 50 may be desirable. FIG. 6 shows an embodiment according to the present disclosure wherein a penetrator 50 includes, e.g., a hollow spike that extends from a sharp tip to a base pivotally coupled to an individual plate 32. A rod 82 may extend through a protector 70 to erect the penetrator 50 in response to inflating the bladder 42. In particular, the bladder 42 may drive the rod 82 in a slot 84 to drive the penetrator 50 from an oblique arrangement in the undeployed arrangement to an approximately orthogonal arrangement in the deployed arrangement of the device 10.

Figure 7A:
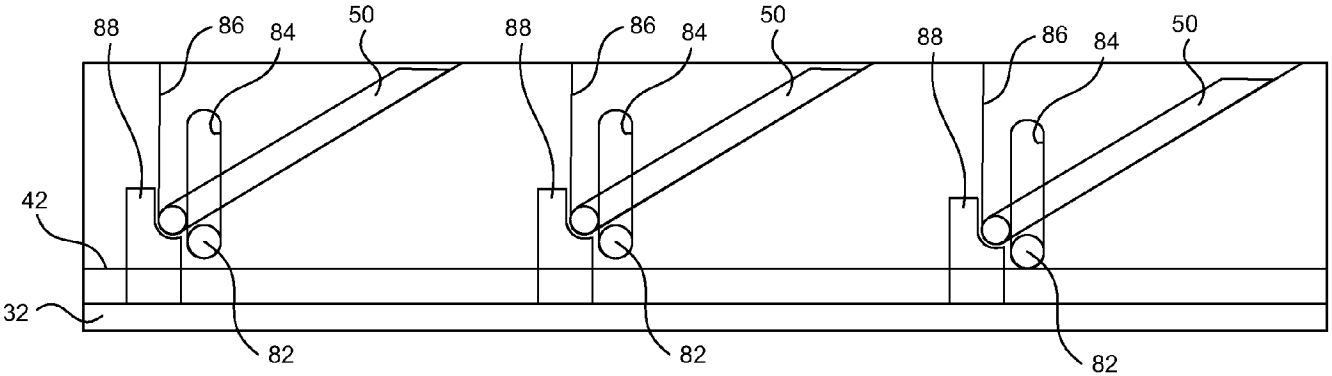
FIGS. 7A and 7B are schematic views illustrating the operation of the spike erector shown in FIG. 6.
Figure 7B:
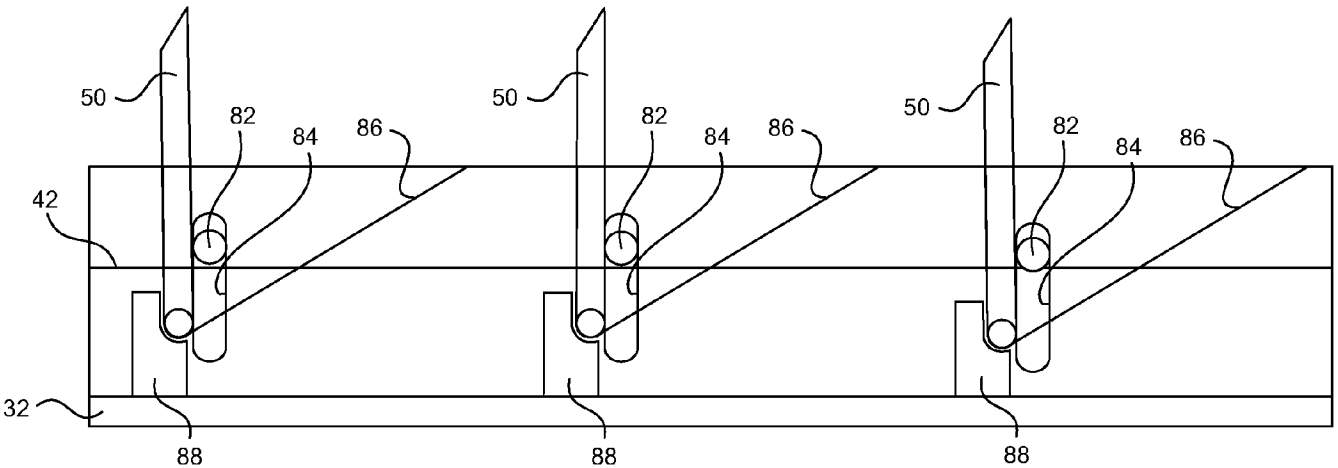

The operation of the erector 80 will be further described with additional reference to FIGS. 7A and 7B. In the undeployed arrangement of the device 10 shown in FIG. 7A, the bladder 42 is uninflated and three penetrators 50 are obliquely arranged with respect to a single plate 32. In particular, each of the penetrators 50 is pivotally coupled to the 32 by respective pivot blocks 88. Individual pockets 86 in the protector 70 may define a range of motion of the penetrators 50, e.g., between the oblique arrangement with respect to the plate 32 in the undeployed arrangement (FIG. 7A) to the approximately orthogonal arrangement with respect to the plate 32 in the deployed arrangement (FIG. 7B). Alternatively or additionally, the pivot blocks 88 may include a disc positioned between the plate 32 and the base of the penetrator 50. A resilient "hair" or sliver of the disc can bias the penetrator 50 toward the undeployed arrangement until a rod 82 erects the penetrator 50. Inflating the bladder 42 drives the rods 82 in the slots 84 and in turn causes the penetrators 50 to pivot in the pivot blocks 88 such that at least a portion of the penetrators 50 project outside of the pockets 86 as shown in FIG. 7B. Accordingly, the erector 80 facilitates using longer penetrators 50 that are concealed by the protector 70 in the undeployed arrangement of the device 10 and are exposed in the deployed arrangement of the device 10. Certain other embodiments according to the present disclosure may use a tape or another flexible tension member (not shown) to erect and/or retract the penetrators 50, possibly in response to the device 10 being deployed or due to a specific erecting action, e.g., provided by the winch 62. Accordingly, it is also envisioned that hinge springs positioned at the first and second joints 34 and 36 may provide additional energy for deploying the strap package 30 and/or pulling on the flexible member to erect the penetrators 50.

Figure 8A:
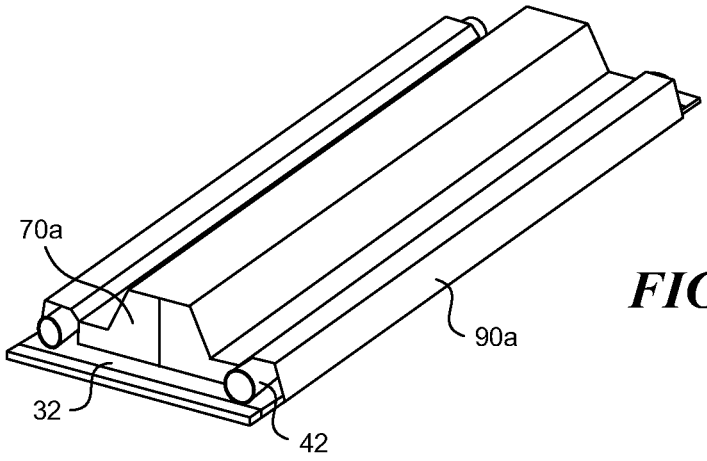
FIGS. 8A-8D are different views of a device according to an embodiment of the present disclosure showing a cover over foam spike protectors.
Figure 8B:
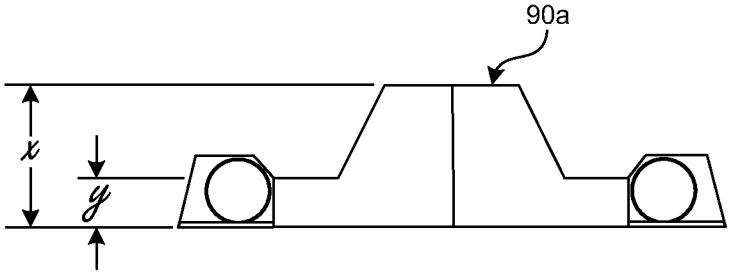
Figure 8C:
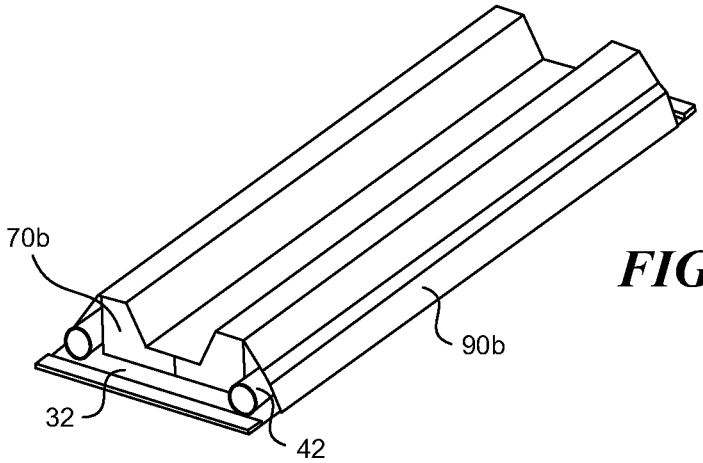
Figure 8D:
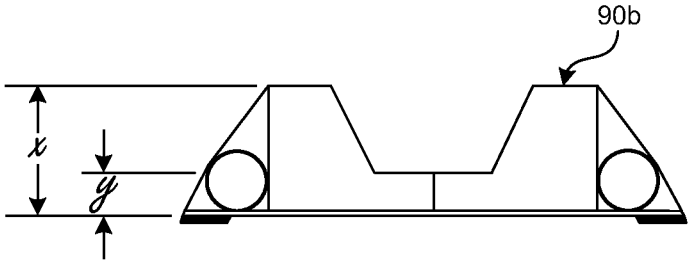

FIGS. 8A-8D show a cover over the foam protectors 70*a* and 70*b* shown in FIG. 5B. FIGS. 8A and 8C show perspective views of the interlocking protectors 70*a* and 70*b* including covers 90*a* and 90*b*, respectively. FIGS. 8B and 8D show cross-section views of the covers 90*a* and 90*b*, respectively. The covers 90 may be fixed, e.g., adhered, to the foam protectors 70 and/or wrap around and be fixed to the plates 32.

The covers 90 also include channels that are sized to accommodate the inflated bladders 42. The covers 90 can include molded plastic, fiber tape or another material suitable for stiffening and/or sheathing the protectors 70.

The deployment of the inflatable strap package 30 will be carried out after the device 10 is positioned for use. A gas generator can be used as the pressure source 44 for deploying of the strap package 30. The gas generator may be activated by an operator from a remote location through use of an actuation device such as a radio signal generator or other remote switching device. Alternatively a proximity detector can be used to actuate the device 10 and deploy the strap package 30 when a target vehicle comes into the range of the proximity detector. By rapidly filling the tubular straps with gas generated in the gas generator, or with gas released from a storage device, the inflatable bladders 42 and the attendant strap package 30 will deploy from the armed position as shown in FIG. 2B to the deployed position as shown in FIG. 2C.

In operation the device 10 will be placed at a location where a target vehicle is expected to pass over the device 10. The device 10 can be placed at the side or on a road, at a check point or choke point inside or between barriers, or anywhere that is in the expected path of a target vehicle. Certain embodiments according to the present disclosure include incorporating the device 10 into typical environmental features to camouflage the presence of the device 10. Once positioned in the expected path of a target vehicle, the device 10 is prepared for deployment by safely arming the device remotely by a proximity sensor, a radio frequency remote activator, a hard-wired controller, etc. Alternatively, the device 10 may be armed by a person opening the housing 20 or having a user trip a switch on the device 10. As a target vehicle approaches the device 10, the strap package 30 will be deployed, e.g., by an operator sending a signal to the device to activate the gas generator to inflate the tubular bladders 42. The target vehicle will drive over the strap package 30 and the penetrators 50 will engage a ground traction device, e.g., tire, on the target vehicle. Thereafter, the tubular bladders 42 may be deflated and the strap package 30 retracted by the winch 62. Accordingly, retracting the device 10 may allow pursuing vehicles, e.g., security personnel vehicles, to not drive over the strap package 30 and the penetrators 50.

The operation of one embodiment according to the present disclosure will now be described. An operator will open the device 10 and retrieve the firing controller (either FOB or auxiliary handheld control box 540), turn ON the system switch 510 and turn the knob 412*a* to open the supply valve 412 to pressurize the accumulator tank 420. This will provide a regulated supply of pressurized gas, e.g., nitrogen at approximately 600 psi, to the accumulator tank 420 from the supply tank 410. The operator will close the supply valve 412 after the accumulator tank 420 reaches equilibrium at the pressure regulated by the pressure regulator 414. This whole process will only take approximately 5 seconds. Now the inflator device 40 is armed. Once deployment is to be initiated, the deployment valve 432 will inflate the bladders 42 thereby causing the strap package 30 to deploy. The deployment valve 432 may remain open for approximately two seconds before closing. The deployed strap package 30 is now deployed and available to engage a target vehicle that runs over the strap package 30 or to be retracted to avoid engaging a vehicle other than a target vehicle. Operation of the retractor device 60 can be prevented for approximately five seconds after deployment commences, thereby preventing premature retraction.

In the case of retracting the strap package 30, e.g., to avoid engaging a vehicle other than the target vehicle, the vent valve 440 is opened and the retraction device 600 is turned ON, e.g., for approximately three seconds, to retract the strap package 30 back into the housing 20. At this point, the both the inflator device 400 and the retractor device 600 may be disabled and cannot be re-activated without turning the power switch OFF and then back ON. Accordingly, the device 10 may include an automatic safety feature after being deployed and retracted.

There may be residual pressure, e.g., approximately 300 psi, in the accumulator tank 420 after the strap package 30 is deployed. The operator may turn the knob 422*a* to open the drain valve 422 to drain off this residual pressure to atmosphere. Certain embodiments according to the present disclosure may be stored with the drain valve 422 in its OPEN setting as a safety feature against compressed gas flowing to the bladders 42 in the undeployed arrangement of the device 10 (FIG. 2A). Additionally, placing the supply valve 412 in its CLOSED setting in the undeployed arrangement of the device 10 provides a precaution to avoid loss of pressure from the high pressure reservoir 410. Certain embodiments according to the present disclosure may include a self-sealing, pressurized bottle as the high pressure reservoir 410. Such a bottle can be disconnected, e.g., unscrewed, from the device 10 as a further precaution to avoid loss of pressure from the high pressure reservoir 410. When storing the device 10, the operator may verify the implementation of the precaution(s) to avoid loss of pressure from the high pressure reservoir 410 and turn OFF the system switch 510.

Figure 9A:
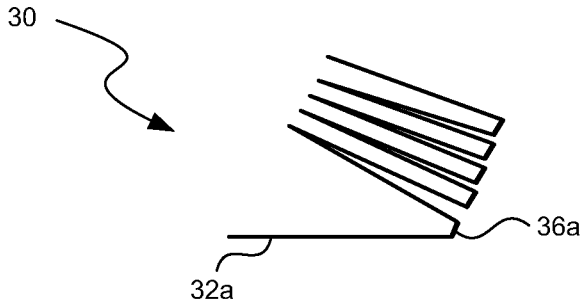
FIGS. 9A-9C schematically show several stages characterizing the deployment dynamics of a device according to an embodiment of the present disclosure.
Figure 9B:
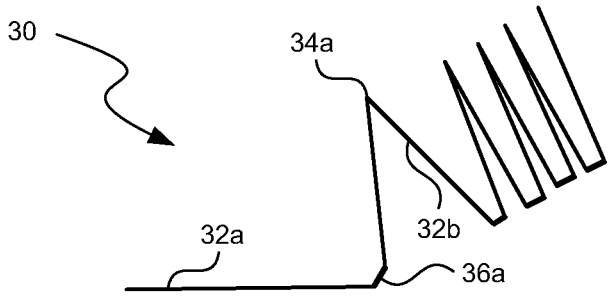
Figure 9C:
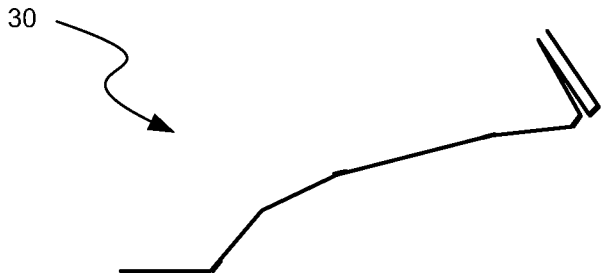

The operation of one embodiment of the strap package 30 according to the present disclosure will now be described with reference to FIGS. 9A-9C. There are several stages that may characterize the deployment dynamics. FIG. 9A shows a first stage including initial stack rotation. The entire backing plate stack rotates about the second joint 36*a* during the first stage. The joint 36*a* keeps the rotating structure aligned and the stack balanced so that there is no 'out of plane' or torsional rotation. FIG. 9B shows a second stage that includes stack rotation and initial launch. The entire stack continues to rotate past an approximately 45 degree angle about the second joint 36*a* and begins exhibit a 'linear' trajectory along the direction of unfurlment (Z-axis). The stack now begins to 'lift' from the plate 32*b*. As with the first stage, the first and second joints 34 and 36 keep the rotating structure aligned and the stack balanced so as to minimize 'out of plane' displacements. FIG. 9B also shows "unkinking" the tubular bladders 42 at the first joint 34*a* such that the next "chamber" or segment of the tubular bladders 42 begins to inflate. FIG. 9C shows a third stage that includes launching the stack. The stack may be a few degrees from vertical and exhibits a forward velocity and kinetic energy. After a successful launch, the first and second joints 34 and 36 ensure that the degrees of freedom during deployment continue to minimize or eliminate 'out of plane' or torsional rotations. Subsequent stages of the deployment dynamics include when the stack is about half its original size and there is enough kinetic energy in the system to extend the remainder of the plates to full deployment. Again, the first and second joints 34 and 36 continue to minimize or eliminate 'out of plane' or torsional rotations by the plates that have 'touched down' on the ground. In a final stage of the deployment dynamics, all of the plates 32 are fully extended. Following deployment, the strap package 30 can be retracted by deflating the bladders 42 and winding the cable 64 with the winch 62. The bladders 42 may be deflated by manual or automatically timed operation of a valve, electromagnetic solenoid, or any other device suitable for releasing gas pressure in the bladders 42.

Figure 10A:
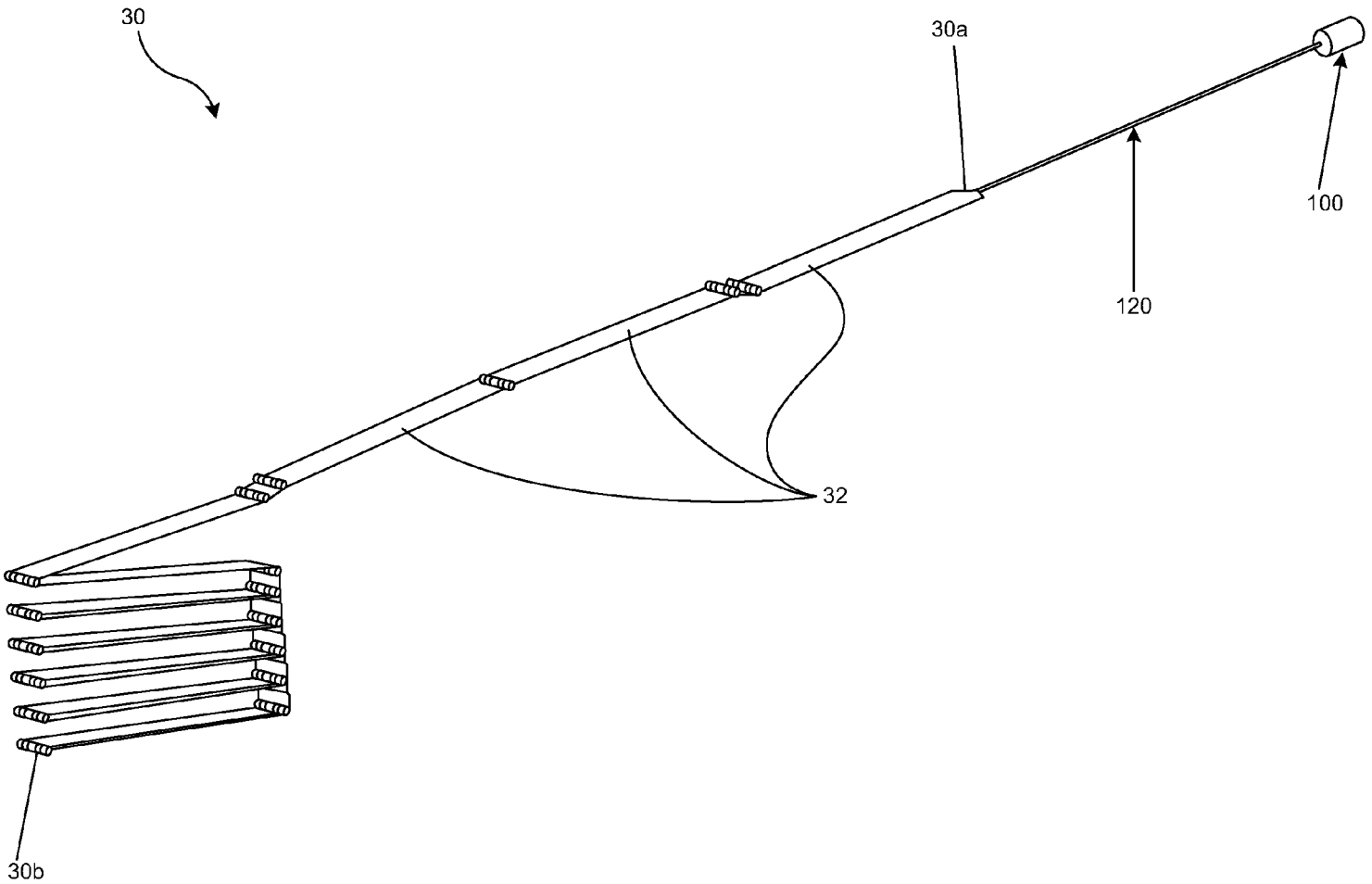
FIGS. 10A and 10B schematically show two stages characterizing the deployment dynamics of a device according to an embodiment of the present disclosure.
Figure 10B:
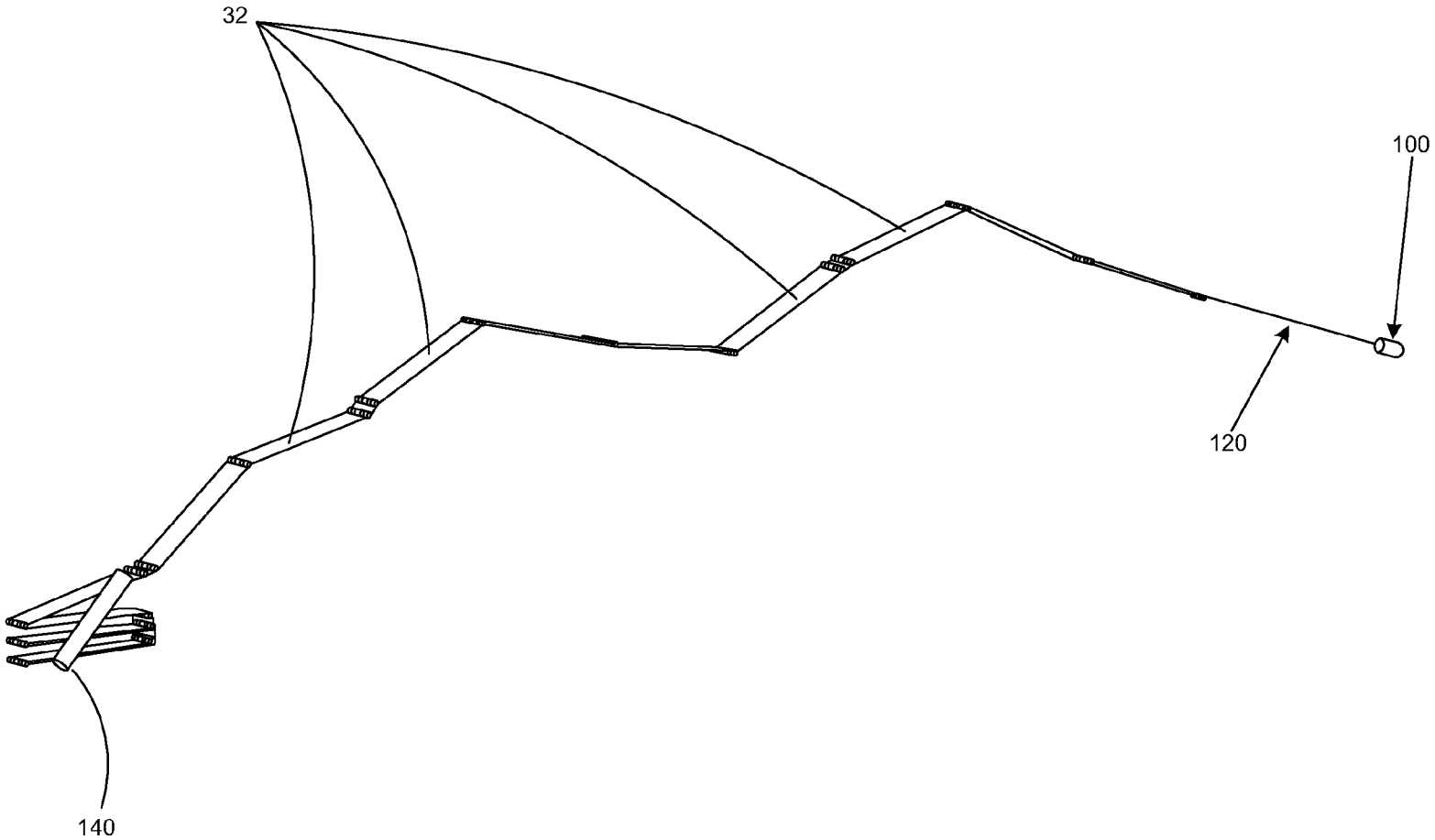

The operation of another embodiment of the strap package 30 according to the present disclosure will now be described with reference to FIGS. 10A and 10B. FIG. 10A shows an early stage of deployment that begins by pulling the plates 32 from a distal end 30*a* of the strap package 30 rather than pushing the plates 32 from a proximal end 30*b* of the strap package 30, as shown in FIGS. 9A-9C. FIG. 10B shows a later stage of deployment after additional plates 32 have been unstacked relative to an undeployed arrangement of the strap package 30.

A projectile 100 coupled to the distal end 30*a* is launched from a barrel 140 for deploying all or at least a portion of the strap package 30. The projectile 100 can include a single, unitary mass or may include a collection of masses, e.g., a bag of shot. The mass and velocity of the projectile 100 are preferably selected so that the kinetic energy of the projectile 100 is non-lethal to a human being. For example, the projectile 100 may have a mass of approximately two-pounds and travel at approximately 70 feet/second.

According to certain embodiments, the projectile 100 includes a bag, sleeve or another flexible container 110 that holds a plurality of smaller masses, e.g., steel shot. An advantage of having plural, smaller masses in a flexible container is minimizing or eliminating bounce or rebound when the projectile 100 impacts an object.

Figure 11:
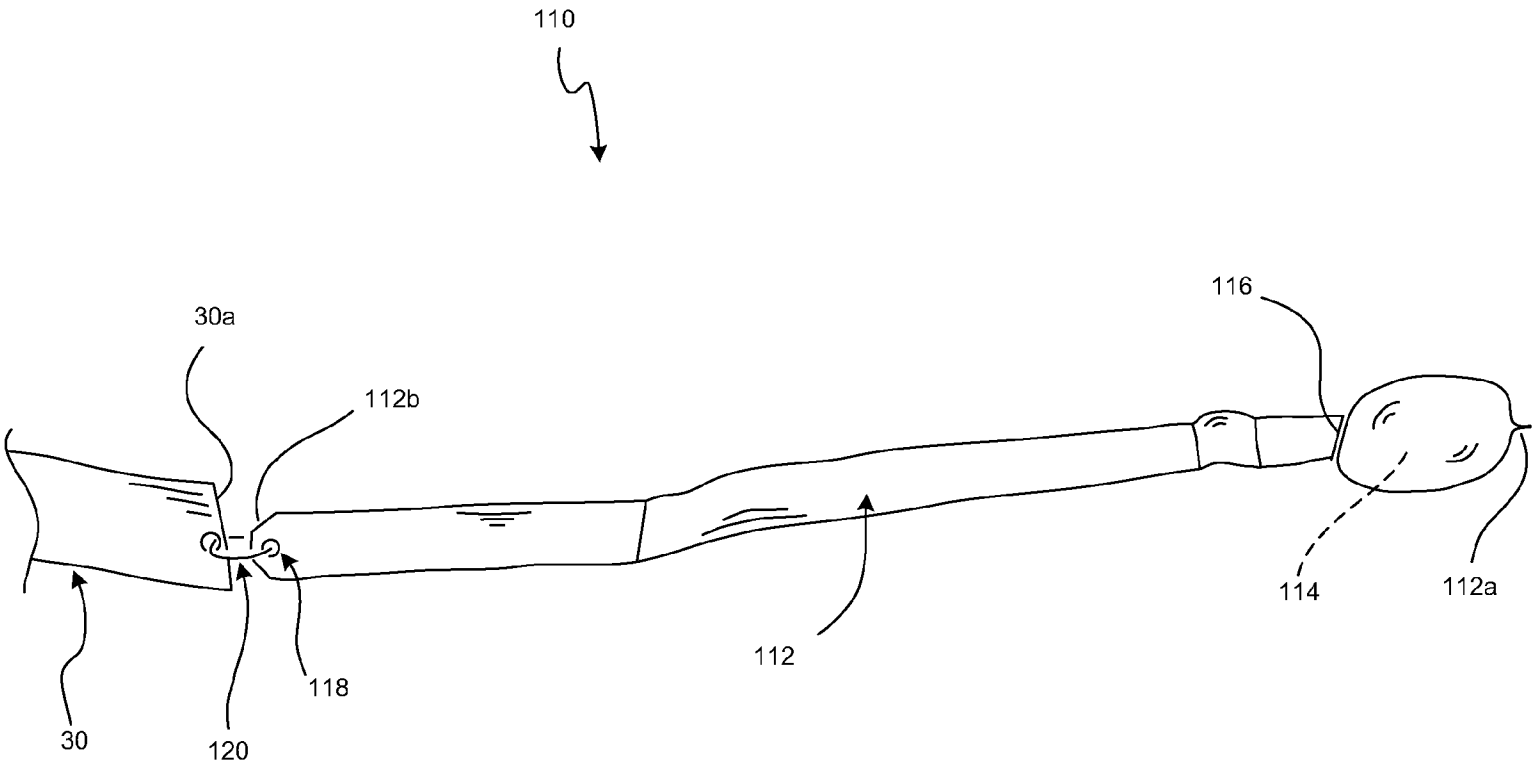
FIG. 11 is a schematic perspective view showing a drogue mass and a flexible connector according to an embodiment of the present disclosure.

FIG. 11 shows an embodiment of a flexible container 110 including a tubular sleeve 112. The tubular sleeve 112 may include polyester or nylon webbing and have a first end 112*a* that is closed, e.g., sewn shut. A pocket 114 for holding the mass(es) may be provided between the closed first end 112*a* and a seam 116 disposed apart from the first end 112*a*. The seam 116 may include sewing or another closure suitable for defining the pocket 114 in the tubular sleeve 112. A connection 118, e.g., a grommet, may be disposed on the flexible container 110 for coupling the projectile 100 to the distal end 30*a* of the strap package 30. The connection 118 is preferably disposed proximate to a second end 112*b* of the flexible container 110.

Other embodiments of the projectile 100 may include other shapes of flexible containers, other container materials, or other closures suitable for defining a container pocket. The projectile 100 may also include a rigid container for holding one or more masses, or a mass container that includes a combination of flexible and rigid materials. The mass may also be provided by or on the distal end 30*a* of strap package 30, e.g., the distal end 30*a* may be loaded into and launched by the barrel 140.

According to certain embodiments, a tether 120 may be used to couple the projectile 100 and the strap package 30. For example, a strap, web, cord, chain or another flexible linkage may extend between and couple the connection 118 on the flexible container 110 and a plate 32 at the distal end 30*a* of the strap package 30. Although it is not particularly shown in the Figures, the plate 32 at the distal end 30*a* may include a reinforced connection, e.g., a grommet, for the coupling the tether 120. The length of the tether 120 is preferably two to five times the length of the barrel 140. The tether 120 may include a resilient material for providing elasticity to the coupling between the projectile 100 and the strap package 30. For example, the tether 120 may include a bungee cord, a spring, or another resilient coupling. An advantage of including resilient material in the tether 120 is storing and distributing the kinetic energy from launching the projectile 100 over the deployment of the strap package 30.

Figure 12:
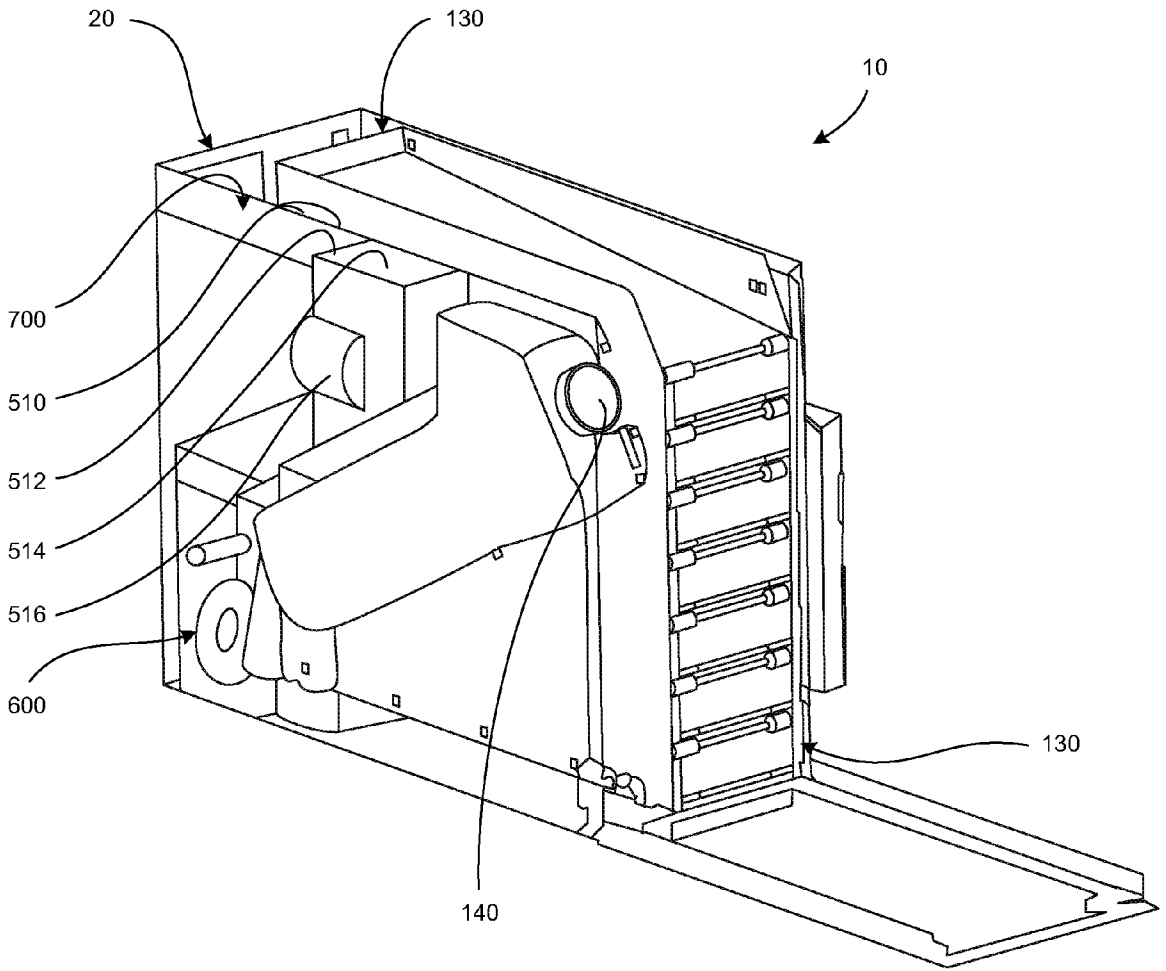
FIG. 12 is a schematic perspective view showing a device according to an embodiment of the present disclosure.

FIG. 12 shows an embodiment of the device 10 that operates according to the deployment depicted in FIGS. 10A and 10B. The device 10 includes a housing 20 (with the side panel removed for better visibility of the interior of the housing) and a replacement tray 130. The housing 20 includes the retractor device 600 and the control panel 700. The retractor device 600 preferably includes a first portion of a mechanical coupling for transferring torque to the drive pulley 62. The control panel 700 preferably includes the system switch 510 for turning ON/OFF or arming the device 10. The control panel 700 preferably further includes one or more of the indicators 512 and 514 for showing the status of the device 10, e.g., showing whether the device 10 is armed, whether the device 10 has been fired, showing the voltage of the power supply 70, etc. Preferably, one of the indicators 512 or 514 includes a liquid crystal display (LCD). Another indicator 516, e.g., another LCD, may be disposed on the exterior of the housing 20 to show the status of the device 10 without opening the housing 20 to reveal the control panel 700.

The replacement tray 130 preferably includes the strap package 30, the drive pulley 62, the power supply 70, and the barrel 140. According to certain embodiments, the tray 130 provides a modular unit that may be separated from the housing 20 for refurbishing the device 10, e.g., after being fired, or for reconfiguring the features or capability of the strap package 30, e.g., changing the length of strap package 30. A lock (not shown) may releasably secure the replacement tray 130 with respect to the housing 20. The drive pulley 62 may include a second portion of the mechanical coupling for transferring torque from the retractor device 600. Mating electrical connectors (not shown) may be disposed on the housing 20 and the replacement tray 130 for electrically coupling the power supply 70, the retractor device 600, the control panel 700, etc.

The barrel 140 is disposed on the replacement tray 130 and oriented at an angle relative to the base of the device 10 for upwardly and outwardly launching the projectile 100. The angle of the barrel 140 relative to the base of the device 10 may be fixed or adjustable. Preferably, the angle of the barrel 140 is approximately 30 degrees relative to the base of the device 10. Dimensions of the barrel 140 may be selected based on various criteria including (1) the space available in the housing 20; (2) the size of the projectile 100; or (3) the force required for launching the projectile 100 from the barrel 140. According to one embodiment, the barrel 140 may have an inside diameter of approximately 40 millimeters (approximately 1 9/16 inches) and have a length of approximately 150 to 400 millimeters (approximately 6 to 16 inches). Preferably, the length of the barrel 140 is approximately 150 to 250 millimeters (approximately 6 to 10 inches).

Figure 13:
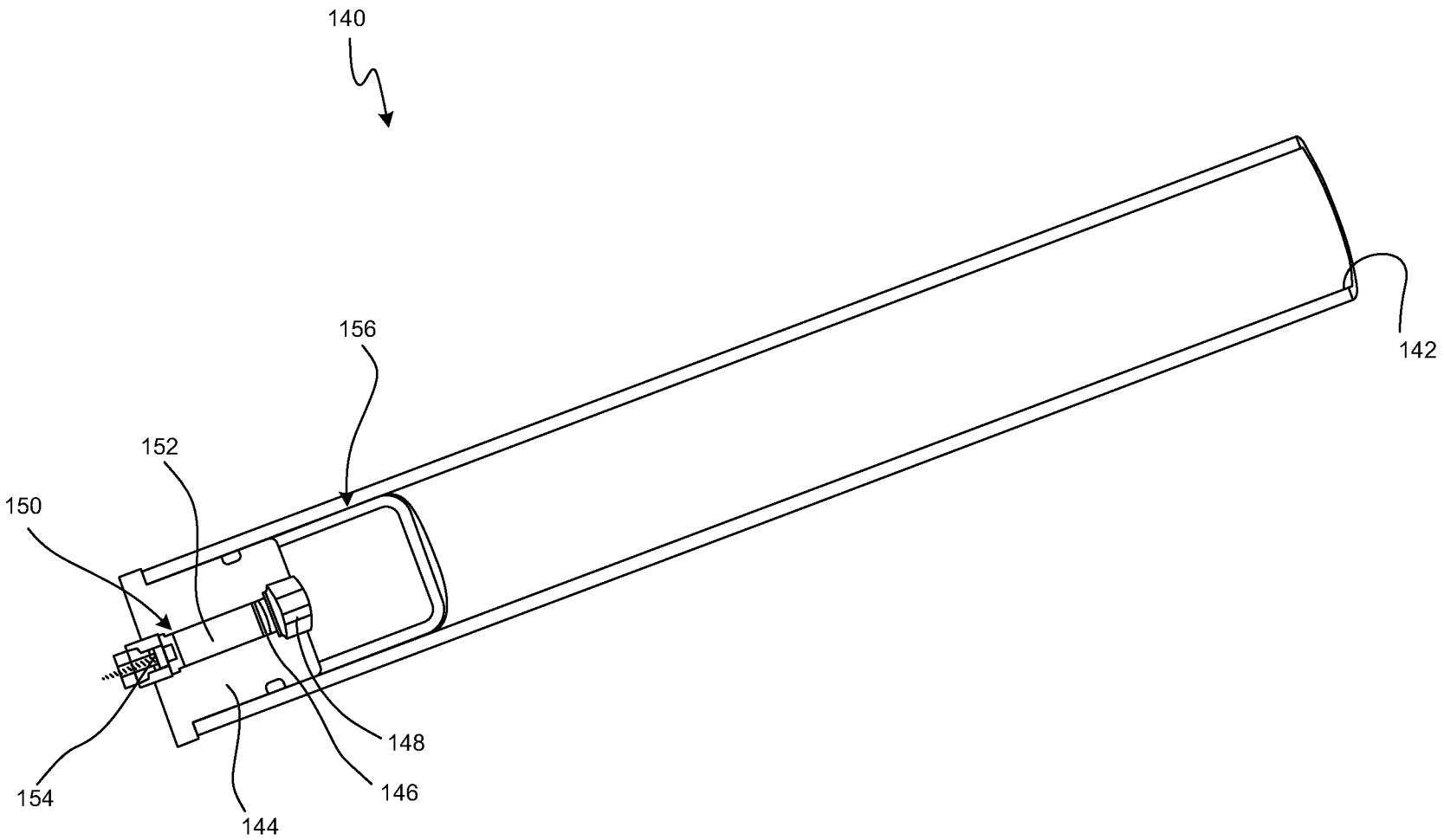
FIG. 13 is a schematic cross-section view showing a barrel and a charge according to an embodiment of the present disclosure.

FIG. 13 shows an embodiment of the barrel 140 and a charge 150 for launching the projectile 100 with the barrel 140. The barrel 140 extends from a muzzle 142 to a breech 144. The breech 144 includes a chamber 146 and a nozzle 148. The charge 150 is disposed in the chamber 148. According to one embodiment, the charge 150 includes a blank cartridge 152 and an electric initiator 154. The blank cartridge 152 preferably includes a small-arms ammunition casing, e.g., nine millimeter, .357 caliber, etc., containing approximately one-half the quantity of gun propellant that is typically loaded in a live round of ammunition. According to certain embodiments, the "throw" or the distance that the blank cartridge 152 launches the projectile 100 from the device 10 may be adjusted by adjusting the quantity of gun propellant in the blank cartridge 152. The electric initiator 154 is preferably used rather than a percussion primer. Accordingly, a FIRE signal from the control panel 700 to the electric initiator 154 ignites the gun propellant in the blank cartridge 152 causing expanding gases to pass through the nozzle 148. The nozzle 148 preferably operates as in a rocket motor for launching the projectile 100 out of the muzzle 142. According to other embodiments, compressed gas or the output of a gas generator may be discharged through the nozzle 148 for launching the projectile 100.

The projectile 100 is preferably loaded in the barrel 140 through the muzzle 142. Accordingly, the tether 120 may extend from the projectile 100, along the barrel 140, out the muzzle 142, to the distal end 30*a* of the strap package 30. A sabot 156 may also be loaded in the barrel 140 between the nozzle 148 and the projectile 100. The sabot 156 forms a tight fit in the bore of the barrel 140 for trapping the gun propellant gases behind the projectile 100 and reducing the gases escaping ahead of the projectile 100. The sabot 156 therefore operates to maximize converting the pressure generated by the charge 150 to the force launching the projectile 100. Preferably, the sabot 156 includes a polyurethane cup. The sabot may be incorporated with the projectile mass to make the two functional parts a single piece or assembly.

Figure 14A:
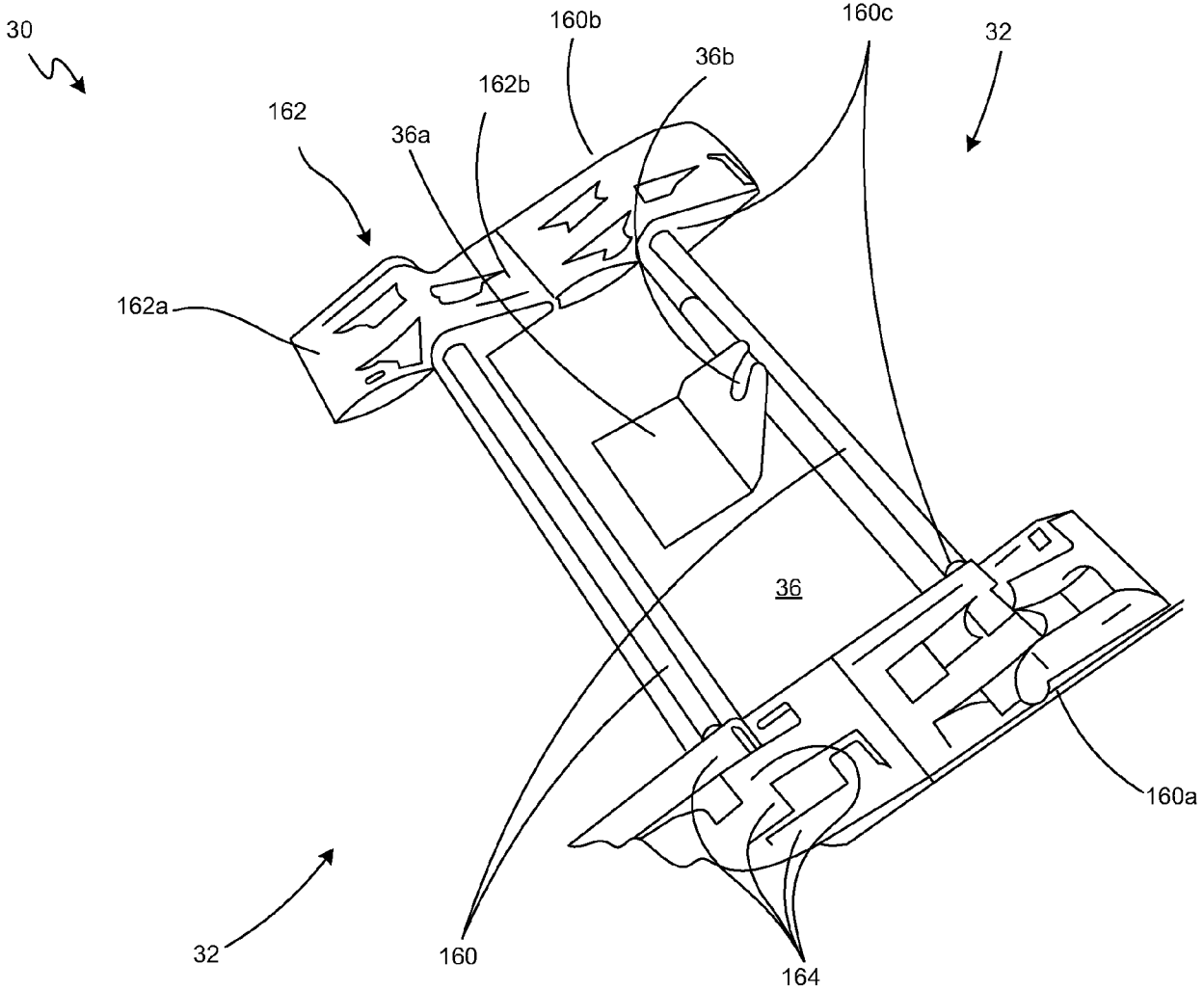
FIGS. 14A and 14B are schematic perspective views showing details of a strap package according to an embodiment of the present disclosure.
Figure 14B:
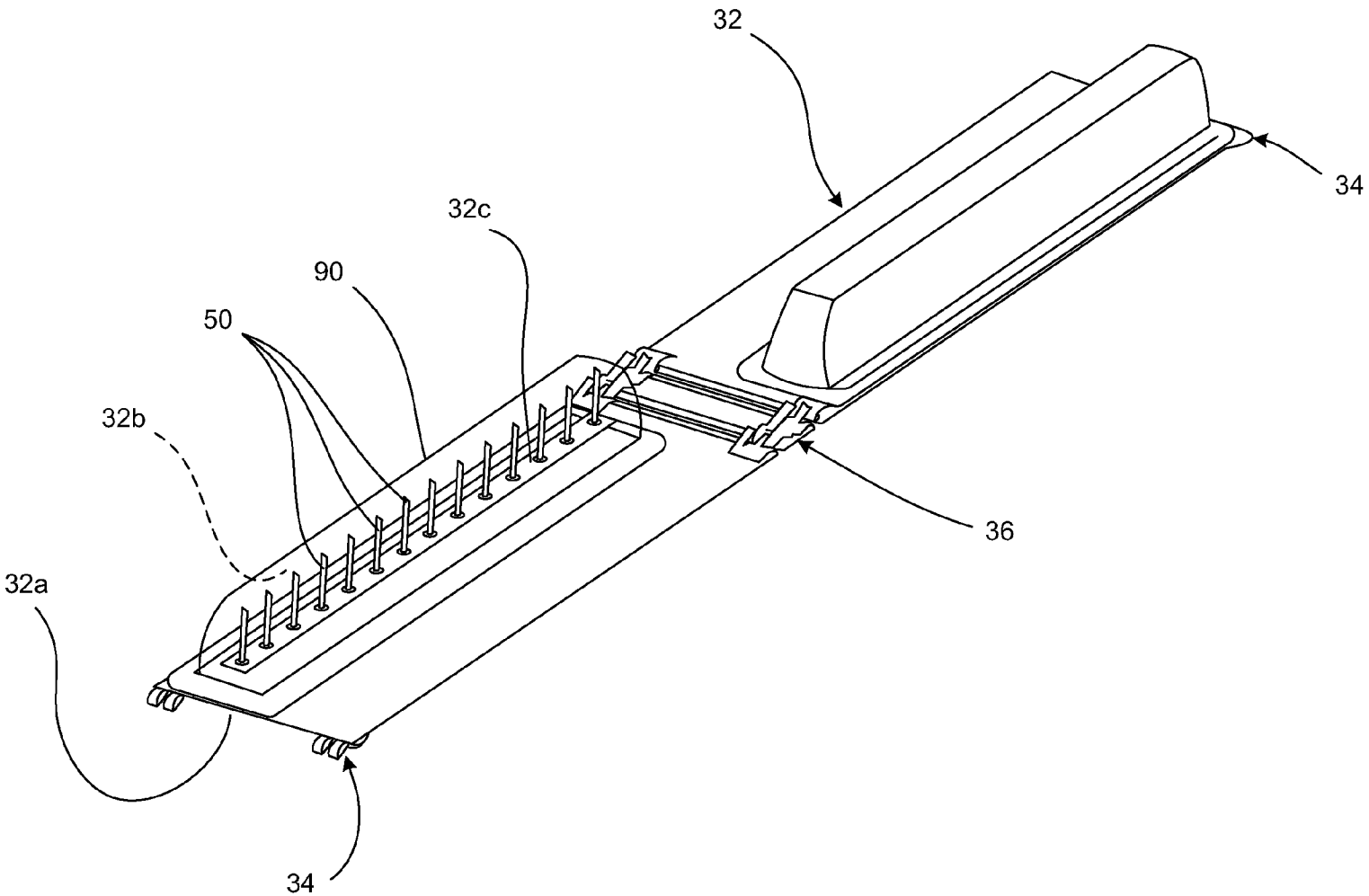

FIGS. 14A and 14B show details of an embodiment of the strap package 30. The plates 32, first joints 34, and second joints 36 are similar to those shown in FIG. 3A; however, the pivot axes of individual first and second joints 34,36 shown FIG. 14A preferably include a split leaf design having interdigitated knuckles disposed at opposite ends of a pin. In particular, an individual pivot axis may include a pin 160 that extends between a first end 160*a* and a second end 160*b*. Preferably, the pin 160 has a longitudinal length that approximately spans the width of a plate 32. Axial movement of the pin 160 may be limited by at least one O-ring 160*c* (two are shown in FIG. 14A) cincturing the pin 160 and abutting against hinges 162. Pairs of interdigitated hinge leaves 162*a* and 162*b* are preferably disposed proximate to the ends 160*a*, 160*b* of each pin 160. Preferably, each of the leaves 162*a*, 162*b* includes a plurality of knuckles 164 (FIG. 14A shows two knuckles 164 on each of the leaves 162*a*,162*b* for a total of four on each hinge 162). Each of the leaves 162*a*,162*b* are coupled, e.g., welded, adhered, bonded, etc., to the "longer" plates 32 or the "shorter" second joints 36. Embodiments according to the present disclosure may include other hinges such as a piano hinge spanning the width of a plate 32, single knuckles on each leaf 162, living hinges, or other approximately parallel pivot axes disposed at each joint of the strap package 30.

Individual plates 32 preferably include a platform 32*a* for delivering a plurality of the penetrators 50, a cover 90 forming a pocket 32*b* with the platform 32*a*, and a penetrator stand 32*c* disposed in the pocket 32*b* for orienting and loosely retaining the penetrators 50. Each of the covers 90 may be vacuum formed including a thermoplastic material, e.g., Acrylonitrile Butadiene Styrene (ABS) or Polystyrene, and coupled, e.g., welded, adhered, bonded, etc., to the platform 32*a*, which may include the same or other materials. The penetrator stand 32*c* preferably is sized and/or shaped to fit in the pocket 32*a* and may abut against or be coupled to the platform 32*a*. The penetrator stand 32*c* includes a plurality of holes that orient the penetrators 50, e.g., relatively perpendicular or obliquely angled, relative to the platform 32*a*. The cover 90 is sized and/or shaped so as to retain the penetrators 50 in their orientation in the penetrator stand 32*c*.

Individual second joints 36 along the length of the strap package 30 may include a tab 36*a* having an eyelet 36*b* for guiding the cable 64 to the retractor device 600. The tabs 36*a* are preferably coupled, e.g., welded, adhered, bonded, etc., to the second joints 36.

Figure 15:
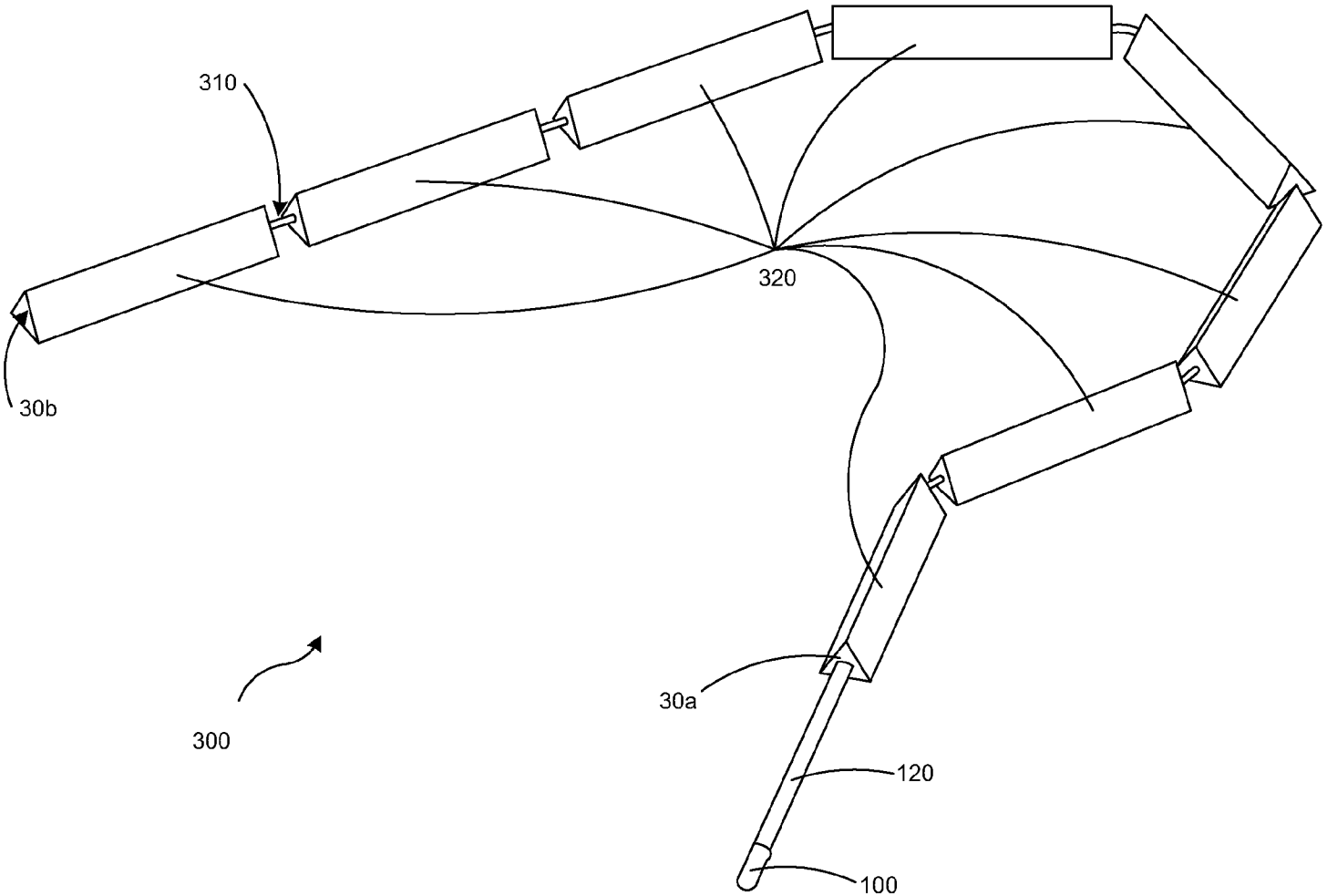
FIG. 15 is a perspective view of an omni-directional strap package according to an embodiment of the present disclosure after the device is deployed.

FIG. 15 shows an omni-directional strap package 300 according to an embodiment of the present disclosure. The strap package 300 includes a flexible linkage 310 that extends along some or the entire length of the strap package 300. The flexible linkage 310 may include, for example, a strap, web, cord, chain or cable, which extends between and couples the distal end 30*a* and the proximal end 30*b* of the strap package 300. The strap package 300 may further extend from the distal end 30*a* to the projectile 100 or may be coupled to the projectile 100 by the tether 120.

The strap package 300 further includes a plurality of sections 320 disposed along the length of the flexible linkage 310. For example, a plurality of sections 320 may be strung together along the flexible linkage 310, similar to a string of beads. The portions(s) of the flexible linkage 310 that extend between adjacent sections 320 provide an articulation that couples the adjacent sections 320. According to certain embodiments of the present specification, the relative positions of individual sections 320 may be fixed along the length of the flexible linkage 310 or the sections 320 may be allowed to move, e.g., slide, along the length of the flexible linkage 310. Certain embodiments according to the present disclosure may also use the flexible linkage 310 to retract the strap package 300. For example, the proximal end 30*b* of the flexible linkage 310 may be coupled to the retractor device 60 (e.g., FIGS. 3C and 4).

The sections 320 may be shaped or otherwise configured so as to have at least one exterior surface that is prone to lay flat on the ground when the strap package 300 is deployed. For example, as shown in FIG. 15, individual sections 320 may have a triangular cross-section when viewed perpendicular to the length of the flexible linkage 310. Accordingly, rather than balancing on any of the three apexes, one of the three surfaces of each individual section 320 is prone to lay flat on the ground when the strap package 300 is deployed. According to certain embodiments of the present specification, the individual sections 320 may include other shapes and/or configurations that are prone to lie on the ground in a preferred manner or orientation. For example, the cross-section of individual sections 320 may be a polygon shape other than a triangle, the individual sections 320 may include an arcuate configuration extending along the length of the flexible linkage 310 (e.g., banana shaped), etc.

Individual sections 320 include a plurality of the penetrators 50. Individual penetrators 50 are preferably disposed in the sections 320 so as to increase the likelihood that at least one of the tires of the target vehicle will be impaled by at least one of the penetrators 50. For example, each flat of a polygon shaped section 320 may provide a backing plate for the base of one or more penetrators 50. Accordingly, there may be a plurality of relative orientations of the penetrators 50 in an individual section 320 and only some of the orientations, e.g., those approximately perpendicular to the ground, depending on the surfaces of the section 320 that is lying on the ground, may impale the target vehicle tire. Other penetrators 50 that are orientated approximately parallel to the ground, e.g., those backed by surfaces that are not lying on the ground, may not impale the target vehicle tire. Certain embodiments according to the present disclosure may dispose the tips of individual penetrators 50 against the inside of a cross-section apex that is opposite the backing surface for that penetrator 50. This preferably maintains the relative orientations of different penetrators 50 and retains the penetrators 50 in the individual sections 320.

An advantage of the device 10 is that it avoids putting security personnel in danger since the device 10 can be placed in position and then deployed and/or retracted remotely. Thus, the person placing the device 10 can stand off from the device 10 at a safe distance from the expected path of a target vehicle, and the strap package 30 of the device 10 can be deployed when a target vehicle approaches the location of the device 10. The remote deployment of the device 10 may therefore be safer than using the convention spike strips that must be manually tossed in front of an approaching target vehicle.

Another advantage of the device 10 is that the strap package 30 is reloadable. In particular, the plates 32, penetrators 50, and pressure source 44 may be reloaded after deploying the device 10. Moreover, only those portions of the device 10 that are used need to be replaced. These portions may include, for example, the crushed sections of foam 70, the removed penetrators 50, and/or the exhausted gas generator 44.

Yet another advantage of the device 10 is the ability to slow, disable, immobilize and/or restrict the movement of a land vehicle with a device that is relatively insensitive to precise placement underneath a target vehicle. Moreover, the device 10 may be automatically and/or remotely armed and triggered for deploying the device 10 with minimal user intervention.

A further advantage of the device 10 is that a strap package 30 operating as shown in FIGS. 10A and 10B can be rapidly deployed, e.g., in approximately one second or less, and rapidly retracted, e.g., in approximately two seconds or less. Further, the device 10 operating as shown in FIGS. 10A and 10B can throw the strap package 30 up to 18 feet or more and may be adjusted to limit the throw to a portion of the maximum length available. For example, an adjustable locking device may secure one or more of the plates 32 with respect to the replacement tray 130 and therefore prevent those plates 32 that are secured from being deployed. According to other embodiments, the hinges 162 may include a breakaway feature for releasing all or part of the strap package 30. For example, the coupling between one or more hinges 162 and plates 32 may have a weakness designed to break when a force in excess of a desired maximum acts on the strap package 30 relative to the rest of the device 10.

An advantage of the omni-directional strap package 300 is the ability to deploy penetrators 50 that increase the likelihood of impaling a target vehicle tire, regardless of how the strap package 300 is deployed. Accordingly, the strap package 300 does not require a single, specific surface of an individual section 320 to lie on the ground, but makes a plurality of orientations for each section 320 effective for impaling the target vehicle tire. Another advantage of the omni-directional strap package 300 is the ability of the flexible linkage 310 to adapt to different ground topographies. Surfaces that have dips, rises, or even barriers between lanes or at the sides of a roadway may be overlaid by the strap package 300.

Figure 16A:
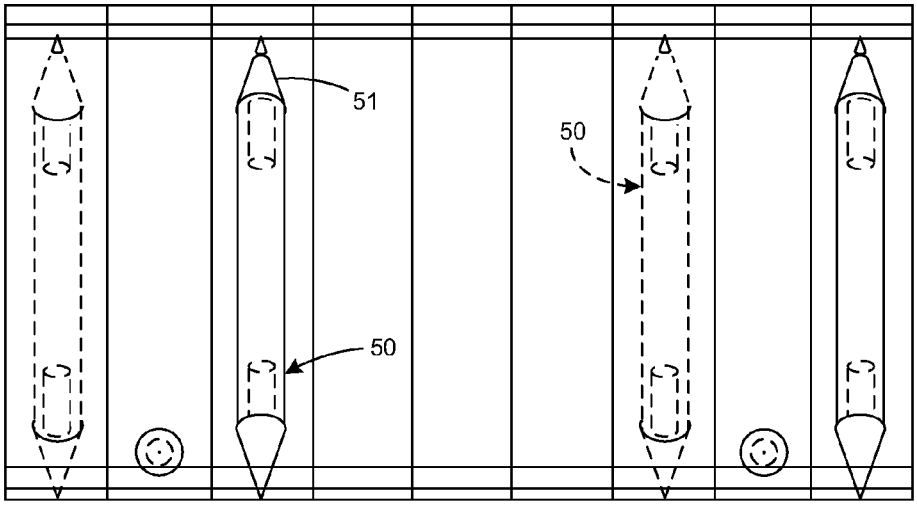
FIGS. 16A and 16B are schematic views showing details of the penetrators arrangement within a section according to an embodiment of the present disclosure.

FIG. 16A shows details of an arrangement of spikes 50 within a section 320. The spikes 50 can be arranged generally parallel to the surfaces of the triangular section 320. The illustrated section 320 can be omni-directional, i.e. capable of engaging the traction device of a ground vehicle irrespective of which side of the section 320 is in contact with the ground. Different arrangements of the spikes 50 within an individual section 320 can be used. For example, the spikes 50 can be arranged such that every third spike is generally parallel to one the surfaces of the section 320. This assures an even distribution of the spikes in their preferred direction (i.e., the direction of the approaching vehicle) irrespective of the section side that is on the ground. Other arrangements of the spikes within the section 320 can be used while preferably providing sufficient number of spikes facing the approaching vehicle irrespective of which surface of the section 320 is on the ground. For example, the spikes may be arranged perpendicularly to the respective surfaces of the triangular section.

Figure 16B:
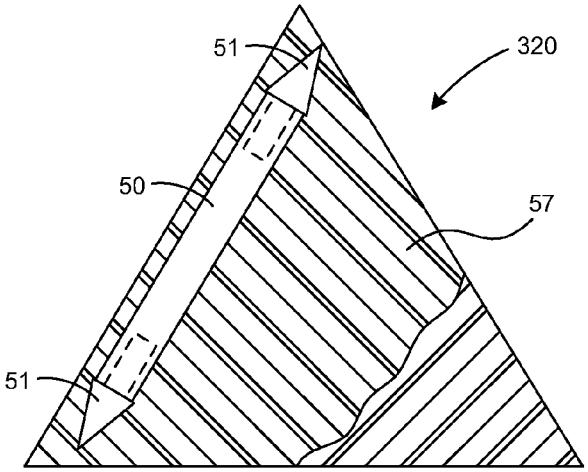

FIG. 16B shows a cross sectional view of an individual spike 50 in the section 320. The spike 50 can be held in a desired orientation by foam 57 (shown as cross-hatching). Suitable nesting spaces may be created in packaging foam 57 for holding the spikes 50 in desired orientation. Different types of foam 57 can be used including, for example, expanded polystyrene (EPS) or packaging foam. In operation, the tires of the approaching vehicle crush foam 57 and the spikes 50 penetrate the tires. The spikes 50 can have caps 51 that are detachable. When the tires of an approaching target vehicle engage with a spike 50, the caps 51 may disengage from the spike, thus decreasing resistance for the air escaping from the impaled tires. Additionally, the detachable caps 51 may reduce the manufacturing cost of section 320. The spikes 50 can be made in different lengths including, for example, 3 inch or 1.5 inch long spikes. The spikes 50 can be made of metals, plastic, wood or other materials of suitable hardness.

Figure 17A:
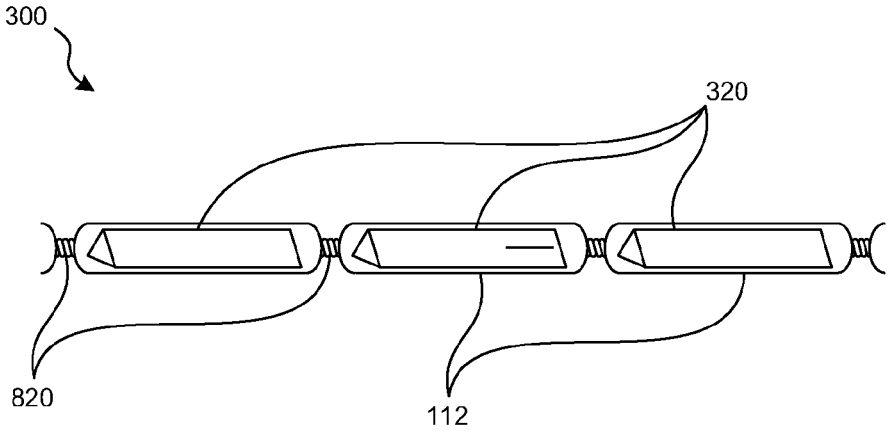
FIGS. 17A and 17B are schematic views showing details of sections arrangement within a sleeve according to an embodiment of the present disclosure.

FIG. 17A schematically illustrates an embodiment of the strap package 300 having a sleeve 112 for holding the sections 320. The sleeve 112 may be made of, for example, textile or plastic foil. If left unrestrained, the sections 320 may have tendency to group together during deployment or retraction. Therefore, stitches 820 may be provided at suitable locations on the sleeve 112 to hold individual sections 320 at their predetermined locations.

Figure 17B:
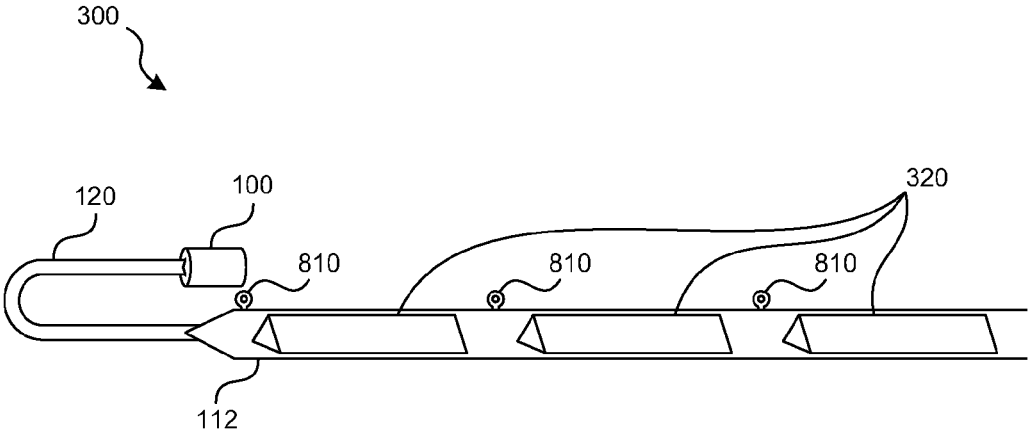

FIG. 17B illustrates an embodiment of the strap package 300 having multiple sections 320 in the sleeve 112. The sections 320 may be separated by stitches 820 (not shown). The strap package 300 may be deployed manually using the projectile 100 and the tether 120. The strap package 300 may also be deployed using the deployment devices explained in more detail with reference to, for example, FIG. 10A or FIGS. 2C-3E above. Several retraction loops 810 can be provided along the sleeve 112 to help retraction of the strap package 300. A cable, a cord or a similar device (not shown) can be passed through the loops 810 to assist in retracting the strap package 300, as explained in more details with reference to FIGS. 18 and 19 below. In some embodiments, the strap package 300 can be retracted by winding it on a reel (not shown).

Figure 18:
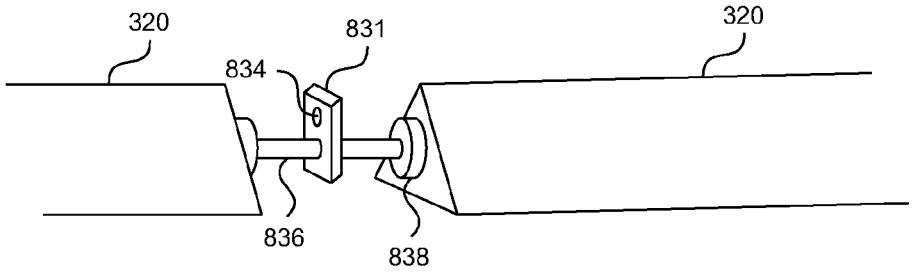
FIG. 18 is a perspective view showing a connection between the sections according to an embodiment of the present disclosure.

FIG. 18 is a partial view of two interconnected sections 320. A guide block 831 can be connected to the sections 320 by guide cables 836. The guide cable attachments 838 can be used to securely attach the cables 836 to the sections 320. Alternatively, the guide cable attachments 838 may be attached to the sleeve (not shown) that houses sections 320. A circular guide hole 834 is illustrated in FIG. 18, but the guide holes having other shapes including, for example, squerical, rectangular, elliptical, etc. may be used. Furthermore, multiple guide holes 834 per guide block 831 can be used. A retraction cable, cord, chain or wire made of metal, plastic, hemp or textile can be passed through guide holes 834 to assist in retracting the strap package, as shown in more details with reference to FIG. 19 below.

Figure 19:
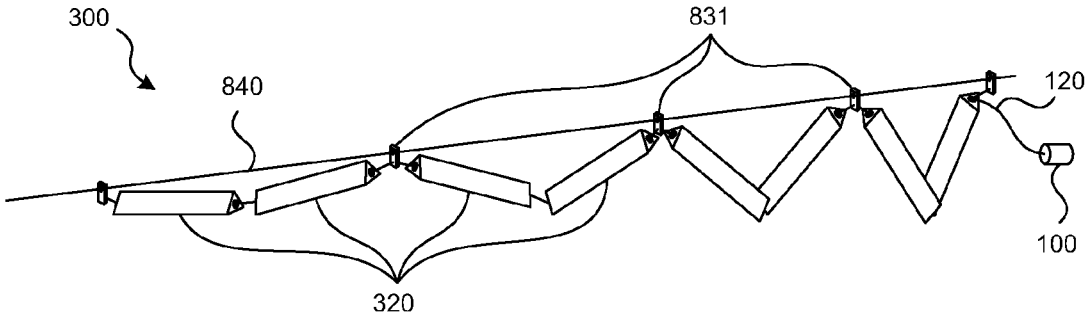
FIG. 19 is a schematic view showing the retraction of the sections using a retraction cable according to an embodiment of the present disclosure.

FIG. 19 schematically illustrates the strap package 300 having a retraction cable 840 passed through the guide holes in the guide blocks 831. The retraction cable 840 can be fixedly secured to the guide block that is proximate to the projectile 100 and/or tether 120. The retraction cable 840 is capable of sliding through the guide holes in the other guide blocks 831. Therefore, the strap package 300 can be retracted from its deployed position by pulling the cable 840, which causes the strap package 300 to fold in. The illustrated embodiment of the strap package 300 has the guide blocks 831 attached to one side of each section 320, but other distributions of the guide blocks along the strap package are also possible like, for example, attaching the guide block 831 to every third or fourth section 320.

Figure 20:
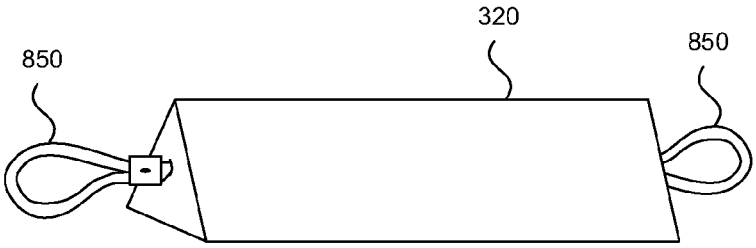
FIG. 20 is a perspective view of a section having chain loops according to an embodiment of the present disclosure.

FIG. 20 illustrates an embodiment of a chain loop 850 that may be suitable for interconnecting the sections 320. For example, the chain loops 850 on the neighboring sections 320 can be interconnected using the retraction cable (not shown) that is passed through every other loop pair. The remaining chain loops 850 can be connected in pairs. When the cable is secured to one chain loop 850 (preferably to a chain loop proximate to the projectile 100), the retraction of the cable will fold back the sections 320, which helps to prepare the strap package 300 for the next deployment or to clean the deployment site.

Figure 21:
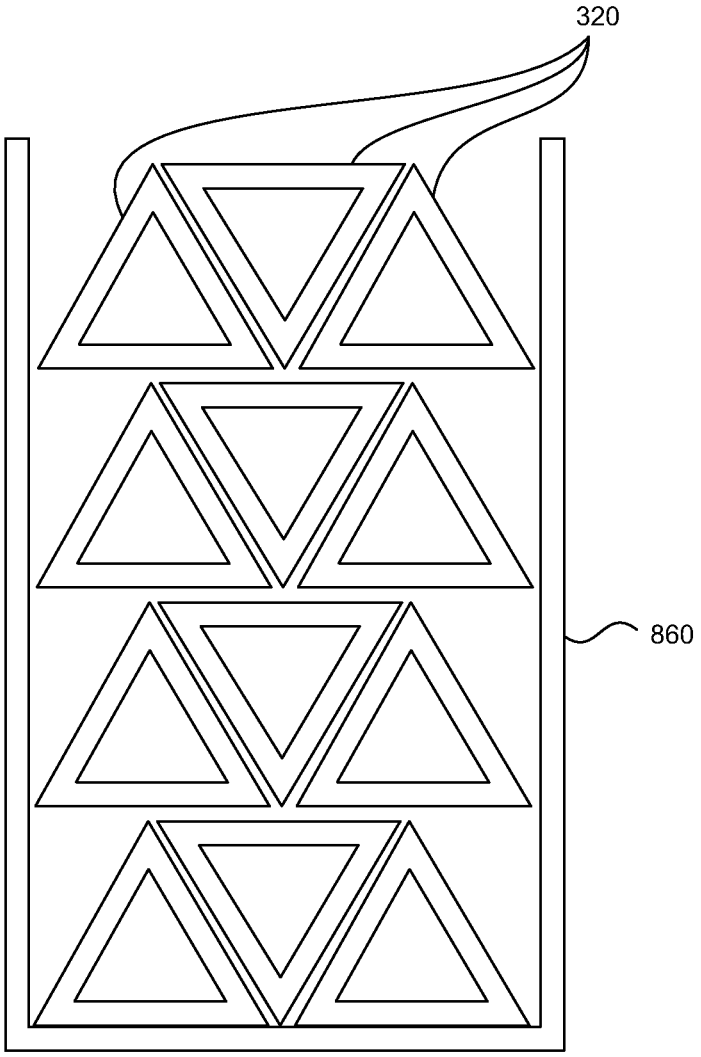
FIG. 21 is a schematic view showing storing of the sections according to an embodiment of the present disclosure.

FIG. 21 schematically illustrates a packaging bin 860 for storing sections 320. Because some embodiments of the sections 320 have essentially triangular cross section, space savings can be achieved by storing the sections 320 as illustrated in FIG. 21. The packaging bin 860 may be used before and/or after deployment of the strap package. A deployment and/or retraction mechanism can be attached to the packaging bin 860.

The above detailed description of embodiments is not intended to be exhaustive or to limit the invention to the precise form disclosed above. Also, well-known structures and functions have not been shown or described in detail to avoid unnecessarily obscuring the description of the embodiments of the present disclosure. While specific embodiments of, and examples for, the invention are described above for illustrative purposes, various equivalent modifications are possible within the scope of the invention, as those skilled in the relevant art will recognize. As an example, certain embodiments of devices 300 according to the present disclosure may include a pressure generator disposed in a device control housing with other operating elements, such as, but not limited to, a pressure delivery manifold, control circuitry to arm and deploy the strap or straps, a proximity detector, a signal receiving and sending circuit and any other hardware, software or firmware necessary or helpful in the operation of the device 10. As another example, the device 10 may be housed in a clamshell-type briefcase or ammunition box type housing and include a pressure manifold and a pressure-generating device, such as compressed gas or a gas generator connected to the manifold. In other embodiments more than one manifold and more than one pressure generating device, or any combination thereof, may be included in the device 10.

Unless the context clearly requires otherwise, throughout the description and the claims, the words "comprise", "comprising", and the like are to be construed in an inclusive sense, as opposed to an exclusive or exhaustive sense; that is to say, in the sense of including, but not limited to. Additionally, the words "herein", "above", "below", and words of similar connotation, when used in the present disclosure, shall refer to the present disclosure as a whole and not to any particular portions of the present disclosure. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

The invention claimed is:

1. An apparatus for disabling a ground engaging traction device of a land vehicle, comprising:

a strap package further comprising— a plurality of penetrators arranged in omni-directional sections, wherein an individual penetrator is configured to breach the traction device, a projectile connected with at least one section, wherein launching the projectile pulls the sections, and at least one flexible linkage connecting the sections; and a launcher coupled to the projectile, wherein activating the launcher causes the projectile to pull the sections, thus deploying the strap package.

2. The apparatus of claim 1 further comprising a tether connecting the projectile with at least one section.

3. The apparatus of claim 1 wherein the omni-directional section has generally triangular cross-section.

4. The apparatus of claim 1 wherein the section further comprises foam for holding the penetrators generally parallel to side walls of the section.

5. The apparatus of claim 1 further comprising a sleeve for housing at least one section.

6. The apparatus of claim 5 wherein the sleeve comprises stitches to separate the sections.

7. The apparatus of claim 5 wherein the sleeve comprises retraction loops configured to receive a retraction cable, wherein pulling the retraction cable causes the apparatus to fold in.

8. The apparatus of claim 1, further comprising:

a guide block; and guide cables connecting the guide block with the sections.

9. The apparatus of claim 8, further comprising guide cable attachments attached the sections and configured to connect the guide cables with the sections.

10. The apparatus of claim 8, further comprising:

a guide hole on the guide block, and a retraction cable slideably passing through at least one guide hole on the guide block, the retraction cable being fixedly attached to at least one guide block, wherein pulling the retraction cable causes the apparatus to fold in.

11. The apparatus of claim 1 wherein the launcher is capable of retracting the strap package.

12. The apparatus of claim 1 wherein the launcher comprises a pyrotechnic device.

13. The apparatus of claim 12 wherein the pyrotechnic devices comprises of a percussion initiated cartridge.

14. The apparatus of claim 12 wherein the pyrotechnic device comprises an electrically initiated blank cartridge.

15. The apparatus of claim 1 further comprising a storage bin for storing the sections after a retraction of the sections.

16. An apparatus for disabling a ground engaging traction device of a land vehicle, comprising:

a strap package further comprising— a plurality of penetrators arranged within omni-directional sections, wherein an individual penetrator is configured to breach the traction device, a sleeve for containing the sections, the sleeve further comprising stitches for separating the sections;

at least one retraction loop attached with the sleeve, the retraction loop configured for receiving a retraction cable;

a tether connected with at least one section, a projectile connected with the tether, wherein launching the projectile pulls the tether, and at least one flexible linkage connecting the sections; and a launcher coupled to the projectile, wherein activating the launcher in a first mode causes the projectile to pull the tether connected to the section, thus deploying the strap package, and activating the launcher in the second mode causes the retraction cable to be pulled, thus folding in the strap package.

17. A method for disabling a ground engaging traction device of a land vehicle, comprising:

launching a projectile connected with strap package, wherein the strap package comprises at least one omni-directional section having penetrators configured to breach the traction device pulling the sections by the projectile, thus deploying the strap package in a path of the land vehicle.

18. The method of claim 17, further comprising pulling a retraction cable to retract the strap package.

19. The method of claim 18 wherein pulling the retraction cable causes:

sliding the retraction cable through at least one guide hole on a guide block attached with the sections, and pulling at least one guide block towards a launching device, thus causing the strap package to fold-in.

20. The method of claim 17 further comprising retracting the articulated strap by winding the strap package onto a reel.

21. The method of claim 17 wherein launching the projectile comprises firing a pyrotechnic device to deploy the projectile.

22. The method of claim 21 wherein firing the pyrotechnic device comprises electrically initiating a blank cartridge in response to an approach of the land vehicle.

* * * * *